US010960677B2

(12) United States Patent
Horade

(10) Patent No.: US 10,960,677 B2
(45) Date of Patent: Mar. 30, 2021

(54) LIQUID DISCHARGE DEVICE

(71) Applicant: BROTHER KOGYO KABUSHIKI KAISHA, Nagoya (JP)

(72) Inventor: Kenta Horade, Toukai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/742,260

(22) Filed: Jan. 14, 2020

(65) Prior Publication Data

US 2020/0147975 A1 May 14, 2020

Related U.S. Application Data

(63) Continuation of application No. 16/156,055, filed on Oct. 10, 2018, now Pat. No. 10,688,799.

(30) Foreign Application Priority Data

Oct. 10, 2017 (JP) ..... JP2017-197155

(51) Int. Cl.
*B41J 2/175* (2006.01)
*B41J 29/38* (2006.01)
*B41J 29/13* (2006.01)

(52) U.S. Cl.
CPC ..... *B41J 2/17566* (2013.01); *B41J 2/1752* (2013.01); *B41J 2/17513* (2013.01);
(Continued)

(58) Field of Classification Search
CPC ... B41J 2/17566; B41J 2/1752; B41J 2/17503
See application file for complete search history.

(56) References Cited

U.S. PATENT DOCUMENTS 6,866,355 B2 * 3/2005 Aruga ..... B41J 2/17509 347/7
8,025,376 B2 * 9/2011 Hattori ..... B41J 2/17543 347/86

(Continued)

FOREIGN PATENT DOCUMENTS

JP 2008-213162 A 9/2008

OTHER PUBLICATIONS

Notice of Allowance issued in related U.S. Appl. No. 16/156,067, dated Feb. 25, 2020.

*Primary Examiner* — Jason S Uhlenhake
(74) *Attorney, Agent, or Firm* — Merchant & Gould P.C.

(57) ABSTRACT

A liquid discharge device includes a case receiving a cartridge having a first liquid chamber, a tank having a second liquid chamber, a head, a liquid level sensor and a controller configured to: receive a first signal or a second signal when a position of a liquid level in the second liquid chamber is equal to or higher than or lower than a predetermined position; prohibit a liquid discharge through the head in a predetermined case; cancel the prohibition of the liquid discharge based on determining that the cartridge is installed in the case; and prohibit the liquid discharge based on determining that a first elapsed time from a time when determining that the cartridge is installed in the installation case reaches a predetermined time and the second signal is received from the liquid level sensor without receiving the first signal.

15 Claims, 14 Drawing Sheets

(52) U.S. Cl.
CPC ..... *B41J 2/17523* (2013.01); *B41J 2/17546* (2013.01); *B41J 2/17553* (2013.01); *B41J 29/13* (2013.01); *B41J 29/38* (2013.01); *B41J 2002/17573* (2013.01); *B41J 2002/17576* (2013.01)

(56) References Cited

U.S. PATENT DOCUMENTS

| | | | |
|---|---|---|---|
| 2008/0204488 | A1 | 8/2008 | Usui |
| 2018/0281438 | A1 | 10/2018 | Horade et al. |
| 2019/0299646 | A1 | 10/2019 | Horade |
| 2019/0299647 | A1 | 10/2019 | Horade |

* cited by examiner

LIQUID DISCHARGE DEVICE

CROSS-REFERENCE TO RELATED APPLICATION

This application is a continuation of U.S. patent application Ser. No. 16/156,055, filed Oct. 10, 2018, which further claims priority from Japanese Patent Application No. 2017-197155 filed on Oct. 10, 2017, the entire subject-matter of both of which is incorporated herein by reference.

TECHNICAL FIELD

The disclosure relates to a liquid discharge device for discharging a liquid.

BACKGROUND

There has been known an inkjet printer including a detachable main tank, a sub tank that stores ink supplied from the installed main tank, and an image recording unit that discharges the ink stored in the sub tank and records an image. In the related-art inkjet printer having the above configuration, internal spaces of the main tank and the sub tank are opened to the air. For this reason, when the main tank is installed in the inkjet printer, the ink moves due to a water head pressure so that the liquid level of the main tank and the liquid level of the sub tank are aligned with the same height by the difference between a water head in the internal space of the main tank and a water head in the internal space of the sub tank (hereinafter, referred to as "water head difference"). Then, the inkjet printer displays exchange of the main tank on a display when the residual amount of the ink detected by a residual amount detection sensor is less than a threshold, or displays the fact that the ink is empty. In addition, the inkjet printer prohibits the discharge of ink through the recording unit when the ink becomes empty.

SUMMARY

Illustrative aspects of the disclosure provide a liquid discharge device including a case receiving a cartridge having a first liquid chamber, a tank having a second liquid chamber, a head, a liquid level sensor and a controller configured to: receive a first signal or a second signal when a position of a liquid level in the second liquid chamber is equal to or higher than or lower than a predetermined position; prohibit a liquid discharge through the head in a predetermined case; cancel the prohibition of the liquid discharge based on determining that the cartridge is installed in the case; and prohibit the liquid discharge based on determining that a first elapsed time from a time when determining that the cartridge is installed in the installation case reaches a predetermined time and the second signal is received from the liquid level sensor without receiving the first signal.

DETAILED DESCRIPTION

Figure 1A:
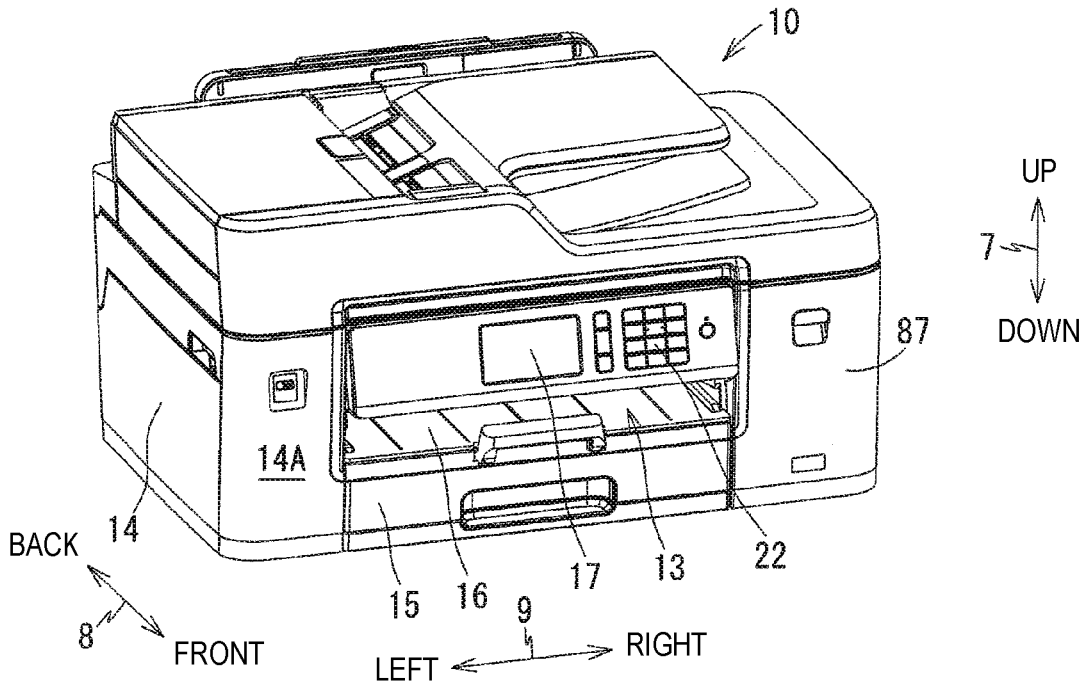
FIG. 1A is an external perspective view of a printer and illustrates a state where a cover is in a covering position.

In the above-explained related-art inkjet printer, when the main tank is exchanged, the ink is discharged from the main tank to the sub tank. If the residual amount detection sensor is also provided to detect the ink in the sub tank, the ink flows from the main tank to the sub tank, and eventually a detection signal of the residual amount detection sensor changes. When the detection signal of the residual amount detection sensor is changed, the inkjet printer may cancel the prohibition of ink discharge through the image recording unit. However, if the ink flows from the main tank to the sub tank and a time is required until when the signal output from the residual amount detection sensor change, the prohibition of ink discharge is not canceled during the time. Therefore, after exchange of the main tank, a user may wonder that the image recording cannot be performed immediately.

The disclosure has been made in view of the above circumstances, and provides a unit capable of releasing prohibition of liquid discharge through a head before a liquid level in a second liquid chamber reaches a predetermined position or more after a cartridge having a first liquid chamber is exchanged.

An exemplary embodiment of the disclosure will be described below. It is noted that the exemplary embodiment described below is merely an example of the disclosure and can be appropriately modified without departing from the spirit of the disclosure. In addition, an up and down direction 7 is defined with reference to a posture of a printer 10 installed in a horizontal plane in a usable manner, a front and back direction 8 is defined with a surface on which an opening 13 of the printer 10 is formed as a front surface, and a left and right direction 9 is defined when viewing the printer 10 from the front surface. In the exemplary embodiment, the up and down direction 7 in the use posture corresponds to a vertical direction, and the front and back direction 8 and the left and right direction 9 correspond to a horizontal direction. The front and back direction 8 and the left and right direction 9 are orthogonal to each other.

(Outline of Printer)

The printer 10 according to the exemplary embodiment is an example of a liquid discharge device that records an image on a sheet using an inkjet recording method. The printer 10 has a housing 14 having substantially rectangular parallelepiped shape. Further, the printer 10 may be a so-called "multifunction peripheral" having a facsimile function, a scan function, and a copy function.

Figure 1B:
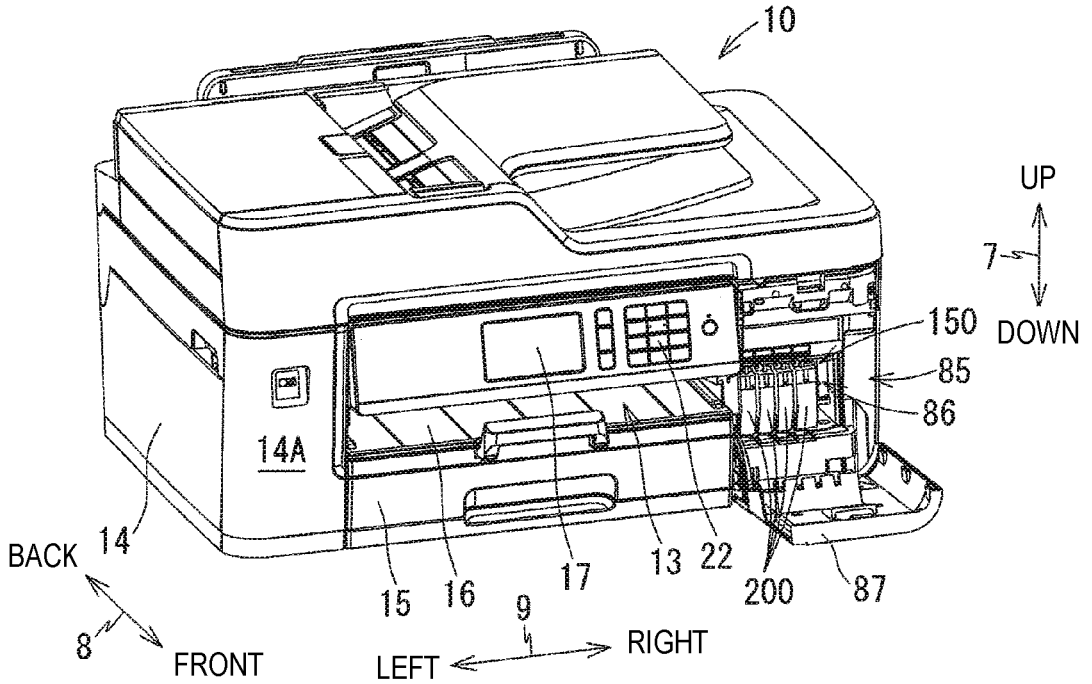
FIG. 1B is an external perspective view of the printer and illustrates a state where the cover is in an exposing position.
Figure 2:
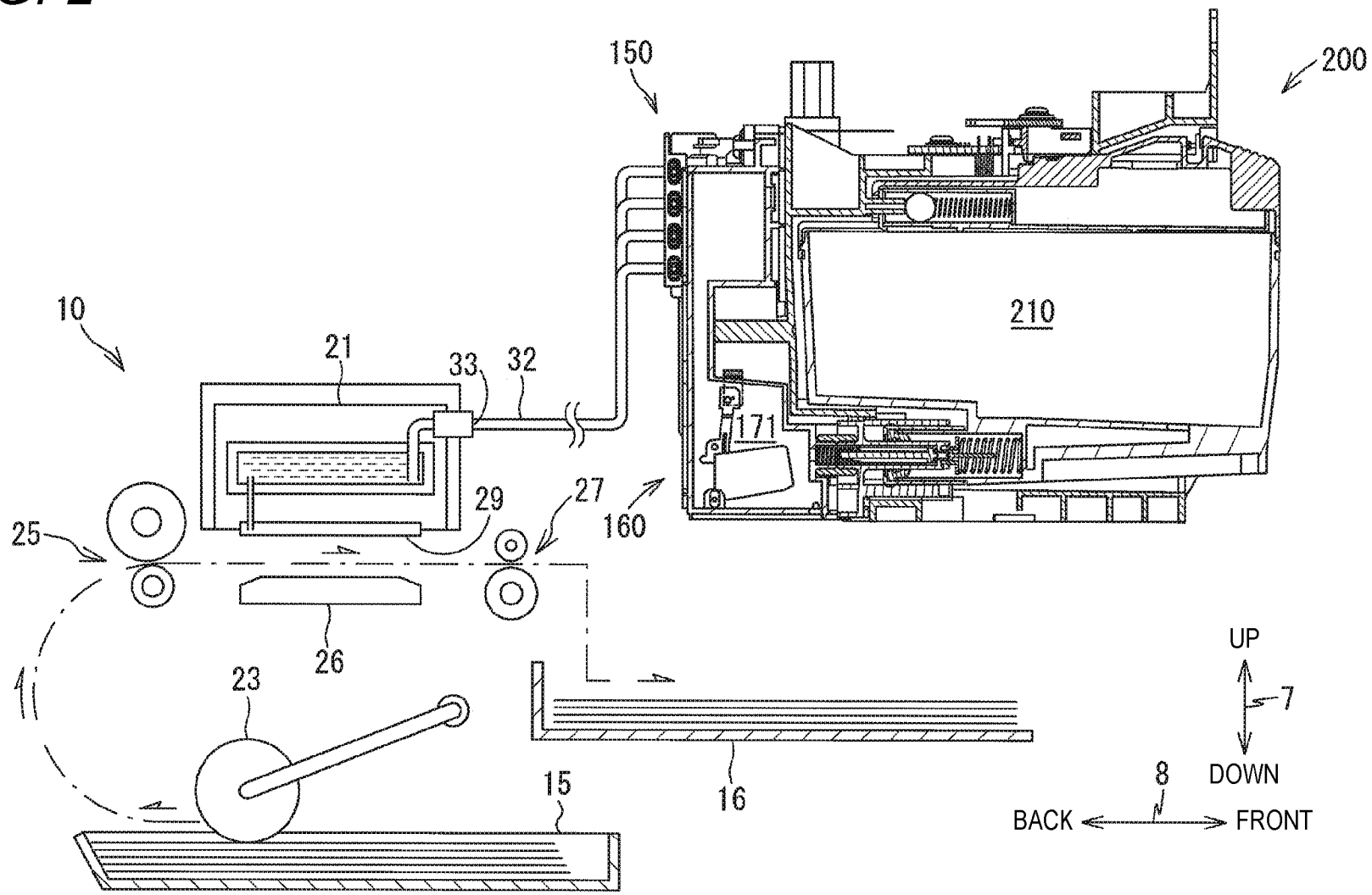
FIG. 2 is a schematic sectional view schematically illustrating an internal structure of the printer.

As illustrated in FIGS. 1A, 1B, and 2, the housing 14 includes therein a feed tray 15, a feed roller 23, a conveyance roller 25, a head 21 including a plurality of nozzles 29, a platen 26 facing the head 21, a discharge roller 27, a discharge tray 16, an installation case 150 to which a cartridge 200 is detachably attached, and a tube 32 for communicating the head 21 with the cartridge 200 installed in the installation case 150.

The printer 10 drives the feed roller 23 and the conveyance roller 25 to convey a sheet supported by the feed tray 15 to the position of the platen 26. Next, the printer 10 discharges an ink, which is supplied from the cartridge 200 installed in the installation case 150 through the tube 32, to the head 21 through the nozzle 29. Thus, the ink is landed on the sheet supported by the platen 26, and an image is recorded on the sheet. Then, the printer 10 drives the discharge roller 27 to discharge the sheet, on which the image is recorded, to the discharge tray 16.

More specifically, the head 21 may be mounted on a carriage that reciprocates in a main scanning direction intersecting with the sheet conveyance direction of the sheet by the conveyance roller 25. Then, the printer 10 may cause the head 21 to discharge ink through the nozzle 29 in the course of moving the carriage from one side to the other side in the main scanning direction. Thus, an image is recorded on a partial area of the sheet (hereinafter, referred to as "one pass") facing the head 21. Next, the printer 10 may cause the conveyance roller 25 to convey the sheet so that a next image recording area of the sheet faces the head 21. Then, these processes are alternately and repeatedly executed, and thus an image is recorded on one sheet.

In the exemplary embodiment, the discharge of ink from the nozzle 29 of the head 21 in the image recording is referred to as "jetting", while the discharge of ink from the nozzle 29 of the head 21 in the purging is referred to as "jetting", but the "jetting" is conceptually included in the "discharge".

(Cover)

As illustrated in FIGS. 1A and 1B, an opening 85 is formed at a right end in the left and right direction 9 on a front surface 14A of the housing 14. The housing 14 further includes a cover 87. The cover 87 is rotatable between a covering position (a position illustrated in FIG. 1A) at which the opening 85 is covered and an exposing position (a position illustrated in FIG. 1B) at which the opening 85 is exposed. The cover 87 is supported by the housing 14 so as to be rotatable around a rotation axis along the left and right direction 9 in the vicinity of a lower end of the housing in the up and down direction 7, for example. Then, the installation case 150 is located in an accommodating space 86 which is provided inside the housing 14 and spreads backwards from the opening 85.

(Cover Sensor)

Figure 6:
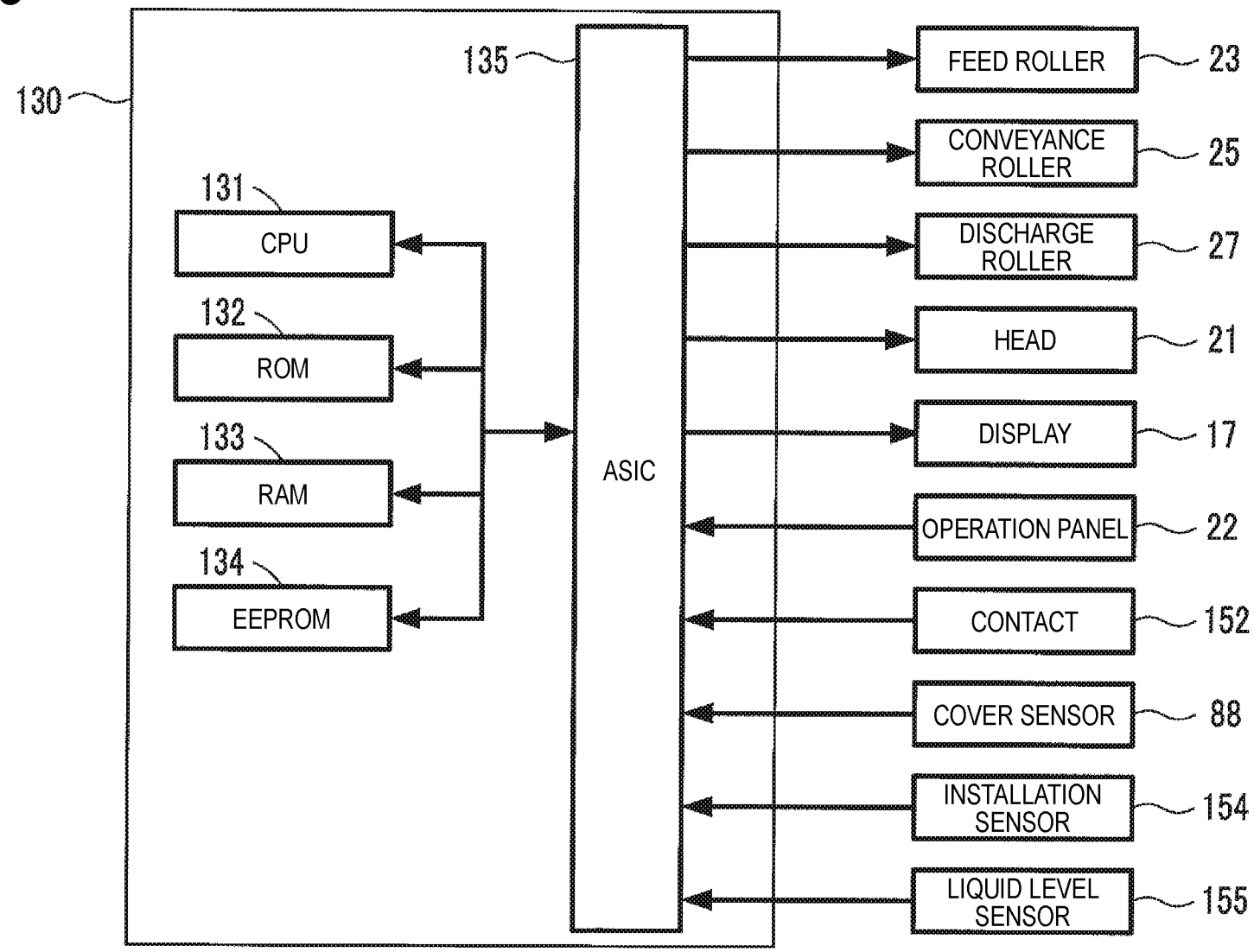
FIG. 6 is a block diagram of the printer.

The printer 10 includes a cover sensor 88 (see FIG. 6). The cover sensor 88 may be, for example, a mechanical sensor such as a switch with and from which the cover 87 contacts and separates, or an optical sensor in which light is blocked or transmitted depending on the position of the cover 87. The cover sensor 88 outputs a signal corresponding to the position of the cover 87 to a controller 130. More specifically, the cover sensor 88 output a low-level signal to the controller 130 when the cover 87 is located at the covering position. On the other hand, the cover sensor 88 outputs a high-level signal having higher signal intensity than the low-level signal to the controller 130 when the cover 87 is located at a position different from the covering position. In other words, the cover sensor 88 outputs the high-level signal to the controller 130 when the cover 87 is located at the exposing position.

(Installation Case)

Figure 3:
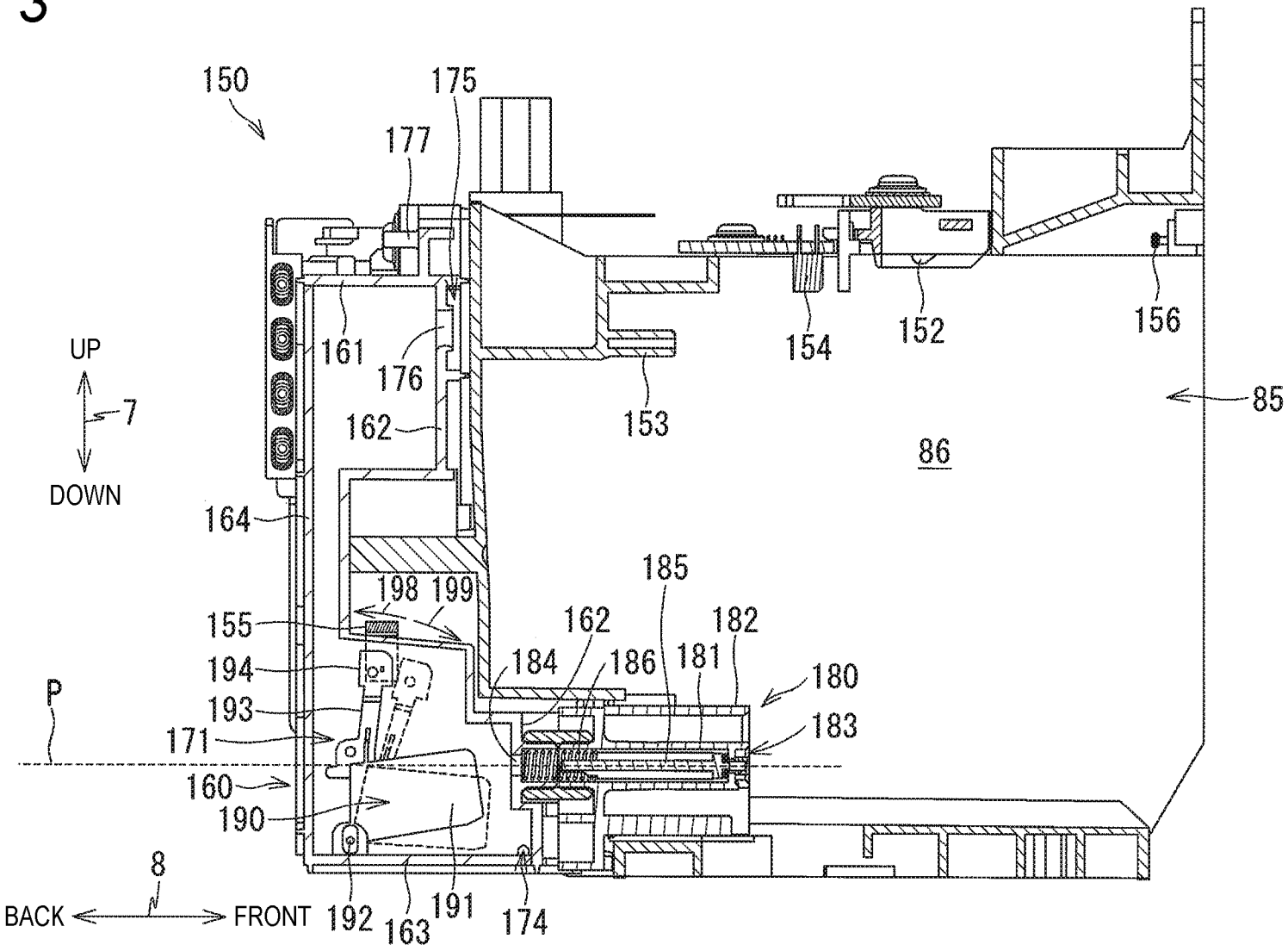
FIG. 3 is a longitudinal sectional view of an installation case.

As illustrated in FIG. 3, the installation case 150 includes a contact 152, a rod 153, an installation sensor 154, a liquid level sensor 155, and a lock pin 156. The installation case 150 can accommodate four cartridges 200 corresponding to respective colors of black, cyan, magenta, and yellow. That is, the installation case 150 includes four contacts 152, four rods 153, four installation sensors 154, and four liquid level sensors 155 corresponding to four cartridges 200. Four cartridges 200 are installed in the installation case 150, but one cartridge or five or more cartridges may be installed. The contact 152 is an example of an interface.

The installation case 150 has a box shape having an internal space in which the cartridge 200 is accommodated. The internal space of the installation case 150 is defined by a top wall defining an upper end top wall, a bottom wall defining a lower end, an inner wall defining a rear end in the front and back direction 8, and a pair of sidewalls defining both ends in the left and right direction 9. On the other hand, the opening 85 is located to face the inner wall of the installation case 150. That is, the opening 85 exposes the inner space of the installation case 150 to the outside of the printer 10 when the cover 87 is disposed at the exposing position.

Then, the cartridge 200 is inserted into the installation case 150 through the opening 85 of the housing 14, and is pulled out of the installation case 150. More specifically, the cartridge 200 passes backwards through the opening 85 in the front and back direction 8, and is installed in the installation case 150. The cartridge 200 pulled out of the installation case 150 passes forward through the opening 85 in the front and back direction 8.

(Contact)

The contact 152 is located on the top wall of the installation case 150. The contact 152 protrudes downwardly toward the internal space of the installation case 150 from the top wall. The contact 152 is located so as to be in contact with an electrode 248 (to be described below) of the cartridge 200 in a state where the cartridge 200 is installed in the installation case 150. The contact 152 has conductivity and is elastically deformable along the up and down direction 7. The contact 152 is electrically connected to the controller 130.

(Rod)

The rod 153 protrudes forward from the inner wall of the installation case 150. The rod 153 is located above a joint 180 (to be described below) on the inner wall of the installation case 150. The rod 153 enters an air valve chamber 214 through an air communication port 221 (to be described below) of the cartridge 200 in the course of installing the cartridge 200 on the installation case 150. When the rod 153 enters the air valve chamber 214, the air valve chamber 214 to be described below communicates with the air.

(Installation Sensor)

The installation sensor 154 is located on the top wall of the installation case 150. The installation sensor 154 is a sensor for detecting whether the cartridge 200 is installed in the installation case 150. The installation sensor 154 includes a light emitting portion and a light receiving portion which are separated from each other in the left and right direction 9. In the state where the cartridge 200 is installed in the installation case 150, a light shielding rib 245 (to be described below) of the cartridge 200 is located between the light emitting portion and the light receiving portion of the installation sensor 154. In other words, the light emitting portion and the light receiving portion of the installation sensor 154 are located opposite to each other across the light shielding rib 245 of the cartridge 200 installed in the installation case 150.

The installation sensor 154 outputs a different signal (denoted as "installation signal" in the drawings) depending on whether the light irradiated along the left and right direction 9 from the light emitting portion is received by the light receiving portion. The installation sensor 154 outputs a low-level signal to the controller when an intensity of the light received by the light receiving portion is lower than threshold intensity, for example. Meanwhile, the installation sensor 154 outputs a high-level signal having higher signal intensity than the low-level signal to the controller 130 when the intensity of the light received by the light receiving portion is equal to or higher than the threshold intensity. The high-level signal is an example of a third signal, and the low-level signal is an example of a fourth signal.

(Liquid Level Sensor)

The liquid level sensor 155 is a sensor for detecting whether a detection target portion 194 of an actuator 190 (to be described below) is located at a detection position. The liquid level sensor 155 includes a light emitting portion and a light receiving portion which are separated from each other in the left and right direction 9. In other words, the light emitting portion and the light receiving portion of the liquid level sensor 155 are located opposite to each other across the detection target portion 194 located at the detection position. The liquid level sensor 155 outputs a different signal (denoted as "liquid level signal" in the drawings) depending on whether the light output from the light emitting portion is received by the light receiving portion. The installation sensor 155 outputs a low-level signal to the controller when an intensity of the light received by the light receiving portion is lower than threshold intensity, for example. Meanwhile, the installation sensor 155 outputs a high-level signal having higher signal intensity than the low-level signal to the controller 130 when the intensity of the light received by the light receiving portion is equal to or higher than the threshold intensity. The high-level signal is an example of a second signal, and the low-level signal is an example of a first signal.

(Lock Pin)

The lock pin 156 is a rod-like member extending along the left and right direction 9 at the upper end of the internal space of the installation case 150 and in the vicinity of the opening 85. Both ends of the lock pin 156 in the left and right direction 9 are fixed to the pair of sidewalls of the installation case 150. The lock pin 156 extends in the left and right direction 9 across four spaces in which four cartridges 200 can be accommodated. The lock pin 156 is used to hold the cartridge 200 installed in the installation case 150 at an installation position illustrated in FIG. 5. The cartridge 200 is engaged with the lock pin 156 in a state of being installed in the installation case 150.

(Tank)

The printer 10 includes four tanks 160 corresponding to four cartridges 200. The tank 160 is located backwards from the inner wall of the installation case 150. As illustrated in FIG. 3, the tank 160 includes an upper wall 161, a front wall 162, a lower wall 163, a rear wall 164, and a pair of sidewalls (not illustrated). The front wall 162 includes a plurality of walls which deviate from each other in the front and back direction 8. A liquid chamber 171 is formed inside the tank 160. The liquid chamber 171 is an example of a second liquid chamber.

Among the walls forming the tank 160, at least the wall facing the liquid level sensor 155 has translucency. Thus, the light output from the liquid level sensor 155 can penetrate through the wall facing the liquid level sensor 155. At least a part of the rear wall 164 may be formed of a film welded to the upper wall 161, the lower wall 163, and an end face of the sidewall. In addition, the sidewall of the tank 160 may be common to the installation case 150, or may be independent of the installation case 150. Moreover, the tanks 160 adjacent to each other in the left and right direction 9 are partitioned by a partition wall (not illustrated). Four tanks 160 have substantially the common configuration.

The liquid chamber 171 communicates with an ink flow path (not illustrated) through an outflow port 174. A lower end of the outflow port 174 is defined by the lower wall 163 defining the lower end of the liquid chamber 171. The outflow port 174 is located below the joint 180 (more specifically, a lower end of a through hole 184) in the up and down direction 7. The ink flow path (not illustrated) communicating with the outflow port 174 communicates with the tube 32 (see FIG. 2). Thus, the liquid chamber 171 communicates with the head 21 from the outflow port 174 through the ink flow path and the tube 32. That is, the ink stored in the liquid chamber 171 is supplied from the outflow port 174 to the head 21 through the ink flow path and the tube 32. Each of the ink flow path and the tube 32 communicating with the outflow port 174 is an example of a fourth flow path in which one end (outflow port 174) communicates with the liquid chamber 171 and the other end 33 (see FIG. 2) communicates with the head 21.

The liquid chamber 171 communicates with the air through an air communication chamber 175. More specifically, the air communication chamber 175 communicates with the liquid chamber 171 through the through hole 176 penetrating the front wall 162. In addition, the air communication chamber 175 communicates with the outside of the printer 10 through an air communication port 177 and a tube (not illustrated) connected to the air communication port 177. That is, the air communication chamber 175 is an example of a fifth flow path in which one end (through hole 176) communicates with the liquid chamber 171 and the other end (air communication port 177) communicates with the outside of the printer 10. The air communication chamber 175 communicates with the air through the air communication port 177 and the tube (not illustrated).

(Joint)

As illustrated in FIG. 3, the joint 180 includes a needle 181 and a guide 182. The needle 181 is a tube in which a flow path is formed. The needle 181 protrudes forward from the front wall 162 defining the liquid chamber 171. An opening 183 is formed at a protruding tip of the needle 181. In addition, the internal space of the needle 181 communicates with the liquid chamber 171 through a through hole 184 penetrating the front wall 162. The needle 181 is an example of a third flow path in which one end (opening 183) communicates with the outside of the tank 160 and the other end (through hole 184) communicates with the liquid chamber 171. The guide 182 is a cylindrical member disposed around the needle 181. The guide 182 protrudes forward from the front wall 162 and has a protruding end which is opened.

In the internal space of the needle 181, a valve 185 and a coil spring 186 are located. In the internal space of the needle 181, the valve 185 is movable between a closed position and an open position in the front and back direction 8. The valve 185 closes the opening 183 when being positioned at the closed position. Further, the valve 185 opens the opening 183 when being located at the open position. The coil spring 186 urges forward the valve 185 in a moving direction from the open position to the closed position, that is, the front and back direction 8.

(Actuator)

The actuator 190 is located in the liquid chamber 171. The actuator 190 is supported by a support member (not illustrated) disposed in the liquid chamber 171 so as to be rotatable in directions of arrows 198 and 199. The actuator 190 is rotatable between a position indicated by a solid line in FIG. 3 and a position indicated by a broken line. Further, the actuator 190 is prevented from rotating in the direction of the arrow 198 from the position of the solid line by a stopper (not illustrated; for example, an inner wall of the liquid chamber 171). The actuator 190 includes a float 191, a shaft 192, an arm 193, and a detection target portion 194.

The float 191 is formed of a material having a smaller specific gravity than the ink stored in the liquid chamber 171. The shaft 192 protrudes in the left and right direction 9 from right and left sides of the float 191. The shaft 192 is inserted into a hole (not illustrated) formed in the support member. Thus, the actuator 190 is supported by the support member so as to be rotatable around the shaft 192. The arm 193 extends substantially upwardly from the float 191. The detection target portion 194 is located at a protruding tip of the arm 193. The detection target portion 194 is a plate-like member extending in the up and down direction 7 and the front and back direction 8. The detection target portion 194 is formed of a material or color that shields the light output from the light emitting portion of the liquid level sensor 155.

When a liquid level of the ink stored in the liquid chamber 171 is equal to or higher than a predetermined position P, the actuator 190 rotated in the direction of the arrow 198 by buoyancy is held at the detection position indicated by the solid line in FIG. 3, by the stopper. On the other hand, when the liquid level of the ink is lower than the predetermined position P, the actuator 190 rotates in the direction of the arrow 199 as the liquid level lowers. Thus, the detection target portion 194 moves to a position out of the detection position. That is, the detection target portion 194 moves to a position corresponding to the amount of ink stored in the liquid chamber 171.

The predetermined position P has the same height as an axial center of the needle 181 in the up and down direction 7, and has the same height as a center of an ink supply port 234 (to be described below). However, the predetermined position P is not limited to the position as long as it is located above the outflow port 174 in the up and down direction 7. As another example, the predetermined position P may be a height of the upper end or the lower end of the internal space of the needle 181, or may be a height of an upper end or a lower end of the ink supply port 234.

When the liquid level of the ink stored in the liquid chamber 171 is equal to or higher than the predetermined position P, the light output from the light emitting portion of the liquid level sensor 155 is blocked by the detection target portion 194. Thus, since the light output from the light emitting portion does not reach the light receiving portion, the liquid level sensor 155 outputs a low-level signal to the controller 130. On the other hand, when the liquid level of the ink stored in the liquid chamber 171 is lower than the predetermined position P, since the light output from the light emitting portion reaches the light receiving portion, the liquid level sensor 155 outputs a high-level signal to the controller 130. That is, the controller 130 can detect from the signal output from the liquid level sensor 155 whether the liquid level of the ink stored in the liquid chamber 171 is equal to or higher than the predetermined position P.

(Cartridge)

Figure 4A:
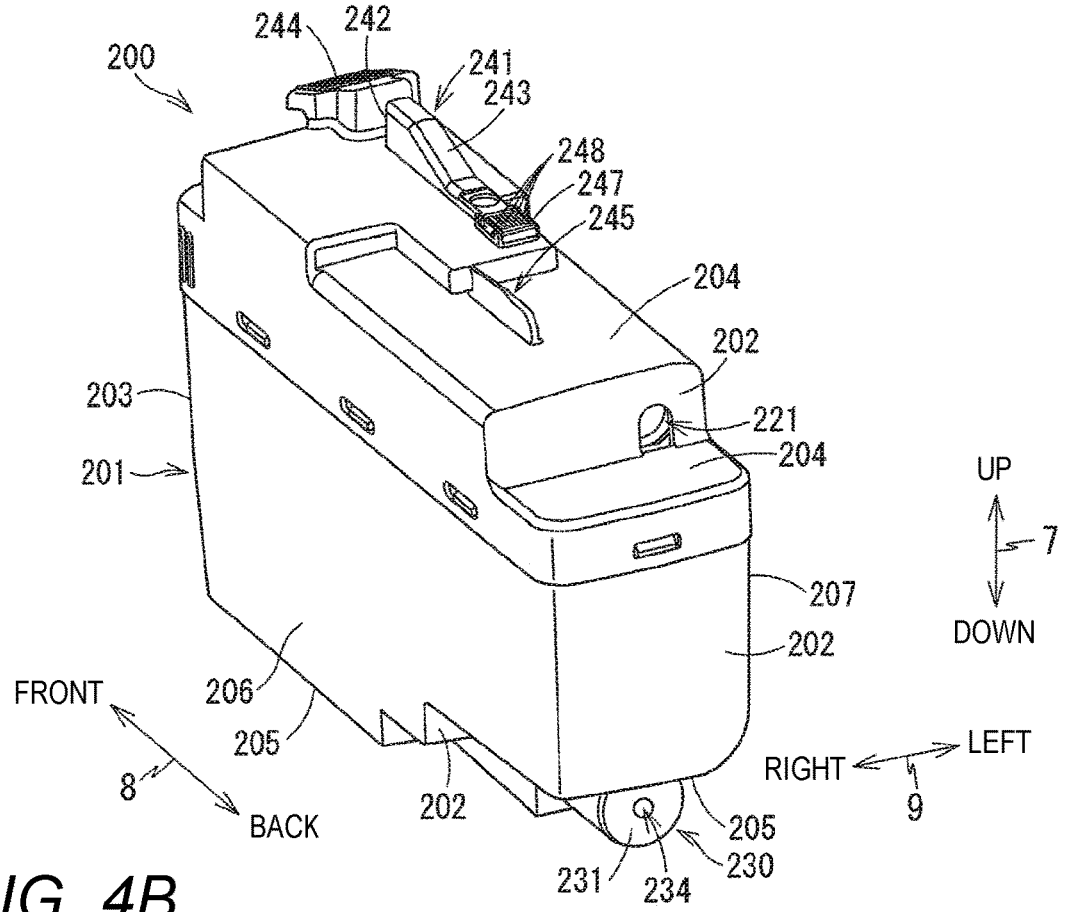
FIG. 4A is a front perspective view illustrating a structure of a cartridge.

The cartridge 200 is a container including a liquid chamber 210 (see FIG. 2) capable of storing ink, which is an example of a liquid, therein. The liquid chamber 210 is defined by a resin wall, for example. As illustrated in FIG. 4A, the cartridge 200 has a flat shape in which dimensions in the up and down direction 7 and the front and back direction 8 are larger than a dimension in the left and right direction 9. The cartridges 200 capable of storing inks of other colors may have the same outer shape or different outer shapes. At least a part of the walls forming the cartridge 200 has translucency. Thus, a user can visually recognize the liquid level of the ink, which is stored in the liquid chamber 210 of the cartridge 200, from the outside of the cartridge 200.

The cartridge 200 includes a housing 201 and a supply tube 230. The housing 201 is formed with a rear wall 202, a front wall 203, an upper wall 204, a lower wall 205, and a pair of sidewalls 206 and 207. The rear wall 202 includes a plurality of walls that deviate from each other in the front and back direction 8. In addition, the upper wall 204 includes a plurality of walls that deviate from each other in the up and down direction 7. Further, the lower wall 205 includes a plurality of walls that deviate from each other in the up and down direction 7.

Figure 4B:
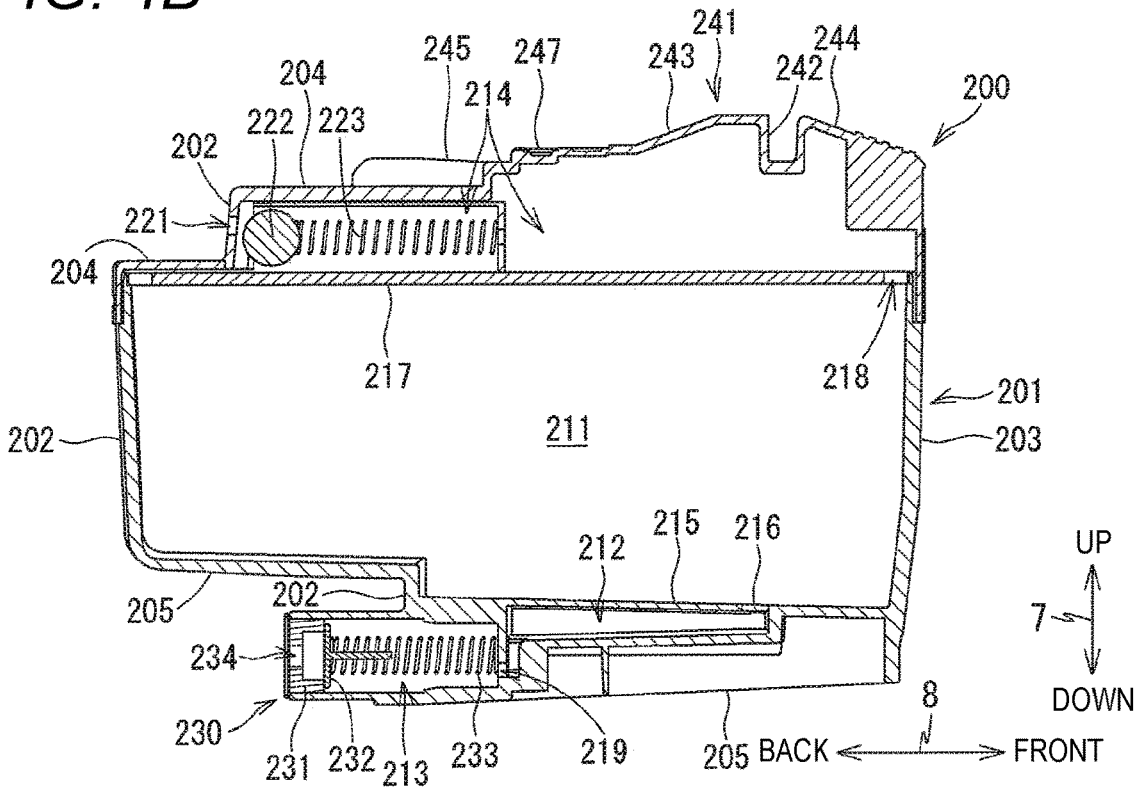
FIG. 4B is a longitudinal sectional view of the cartridge.

In the internal space of the cartridge 200, as illustrated in FIG. 4B, a liquid chamber 210, an ink valve chamber 213, and an air valve chamber 214 are formed. The liquid chamber 210 includes an upper liquid chamber 211 and a lower liquid chamber 212. The upper liquid chamber 211, the lower liquid chamber 212, and the air valve chamber 214 are internal spaces of the housing 201. On the other hand, the ink valve chamber 213 is an internal space of the supply tube 230. The liquid chamber 210 stores ink. The air valve chamber 214 allows the liquid chamber 210 and the outside of the cartridge 200 to communicate with each other. The liquid chamber 210 is an example of a first liquid chamber.

The upper liquid chamber 211 and the lower liquid chamber 212 of the liquid chamber 210 are separated from each other in the up and down direction 7 by a partition wall 215 that partitions the internal space of the housing 201. Then, the upper liquid chamber 211 and the lower liquid chamber 212 communicate with each other through a through hole 216 formed in the partition wall 215. In addition, the upper liquid chamber 211 and the air valve chamber 214 are separated from each other in the up and down direction 7 by a partition wall 217 that partitions the internal space of the housing 201. Then, the upper liquid chamber 211 and the air valve chamber 214 communicate with each other through a through hole 218 formed in the partition wall 217. Further, the ink valve chamber 213 communicates with a lower end of the lower liquid chamber 212 through a through hole 219.

The air valve chamber 214 communicates with the outside of the cartridge 200 through the air communication port 221 formed in the rear wall 202 at the upper part of the cartridge 200. That is, the air valve chamber 214 is an example of a second flow path in which one end (through hole 218) communicates with the liquid chamber 210 (more specifically, the upper liquid chamber 211) and the other end (air communication port 221) communicates with the outside of the cartridge 200. The air valve chamber 214 communicates with the air through the air communication port 221. In addition, a valve 222 and a coil spring 223 are located in the air valve chamber 214. The valve 222 is movable between a closed position and an open position in the front and back direction 8. When being located at the closed position, the valve 222 closes the air communication port 221. Further, when being located at the open position, the valve 222 opens the air communication port 221. The coil spring 223 urges backward the valve 222 in a moving direction from the open position to the closed position, that is, the front and back direction 8.

The rod 153 enters the air valve chamber 214 through the air communication port 221 in the course of installing the cartridge 200 on the installation case 150. The rod 153 having entered the air valve chamber 214 moves forward the valve 222 located at the closed position against an urging force of the coil spring 223. Then, as the valve 222 moves to the open position, the upper liquid chamber 211 communicates with the air. The configuration for opening the air communication port 221 is not limited to the above example. As another example, a configuration may be adopted in which the rod 153 breaks through a film that seals the air communication port 221.

The supply tube 230 protrudes backward from the rear wall 202 in the lower part of the housing 201. The protruding end (that is, a rear end) of the supply tube 230 is opened. That is, the ink valve chamber 213 allows the liquid chamber 210 communicating through the through hole 219 and the outside of the cartridge 200 to communicate with each other. The ink valve chamber 213 is an example of a first flow path in which one end (through hole 219) communicates with the liquid chamber 210 (more specifically, the lower liquid chamber 212) and the other end (an ink supply port 234 which will be described below) communicates with the outside of the cartridge 200. In the ink valve chamber 213, a packing 231, a valve 232, and a coil spring 233 are located.

At the center of the packing 231, an ink supply port 234 penetrating in the front and back direction 8 is formed. An inner diameter of the ink supply port 234 is slightly smaller than an outer diameter of the needle 181. The valve 232 is movable between a closed position and an open position in the front and back direction 8. When being located at the closed position, the valve 232 comes in contact with the packing 231 and closes the ink supply port 234. Further, when being located at the open position, the valve 232 separates from the packing 231 and opens the ink supply port 234. The coil spring 233 urges backward the valve 232 in a moving direction from the open position to the closed position, that is, the front and back direction 8. In addition, the urging force of the coil spring 233 is larger than that of the coil spring 186.

The supply tube 230 enters the guide 182 in the course of installing the cartridge 200 on the installation case 150, and the needle 181 eventually enters the ink valve chamber 213 through the ink supply port 234. At this time, the needle 181 makes liquid-tight contact with the inner peripheral surface defining the ink supply port 234 while elastically deforming the packing 231. When the cartridge 200 is further inserted into the installation case 150, the needle 181 moves forward the valve 232 against an urging force of the coil spring 233. In addition, the valve 232 moves backward the valve 185 protruding from the opening 183 of the needle 181 against the urging force of the coil spring 186.

Figure 5:
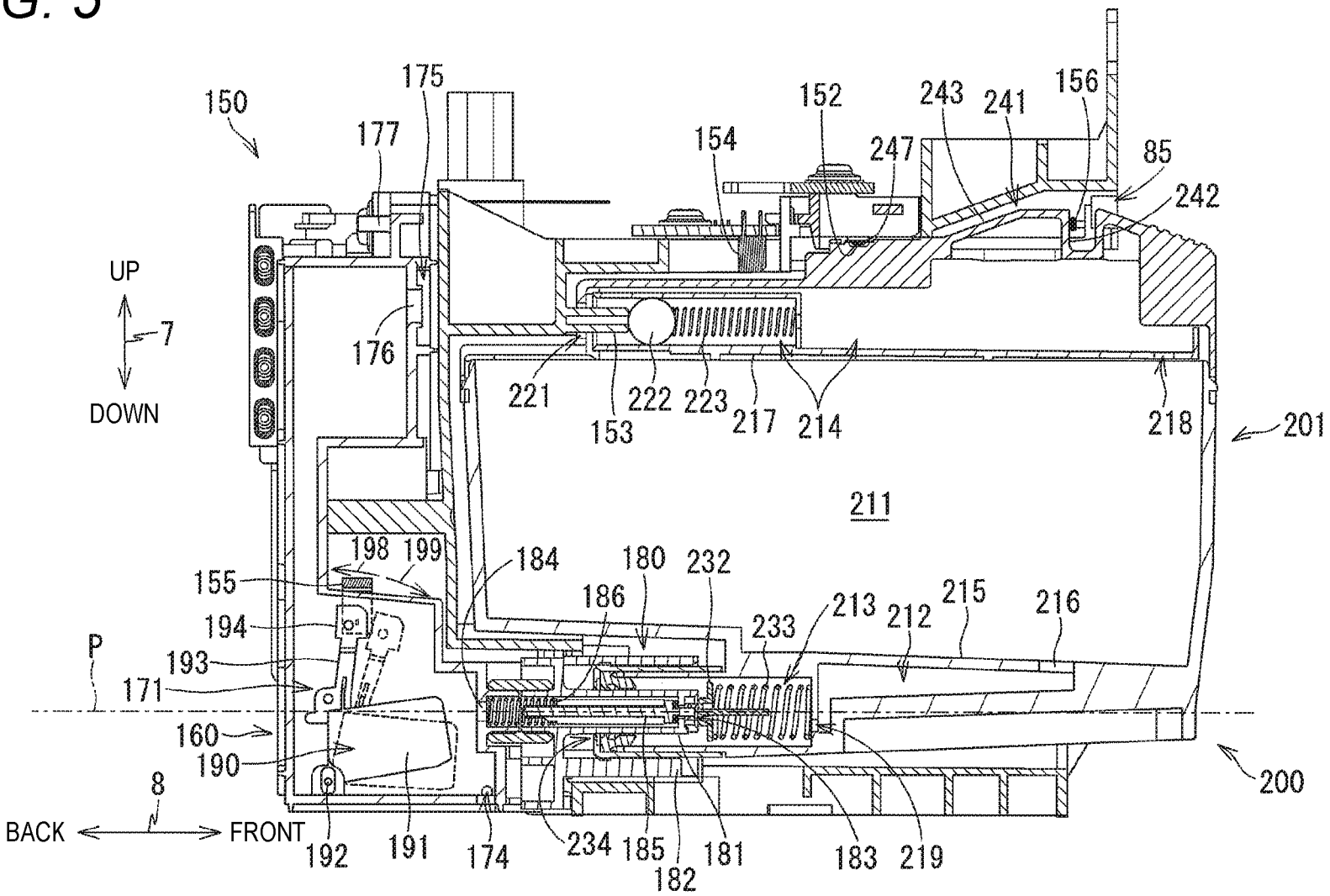
FIG. 5 is a longitudinal sectional view illustrating a state where the cartridge is installed in the installation case.

Thus, as illustrated in FIG. 5, the ink supply port 234 and the opening 183 are opened, and the ink valve chamber 213 of the supply tube 230 communicates with the internal space of the needle 181. That is, in the state where the cartridge 200 is installed in the installation case 150, the ink valve chamber 213 and the internal space of the needle 181 form a flow path through which the liquid chamber 210 of the cartridge 200 communicates with the liquid chamber 171 of the tank 160.

In the state where the cartridge 200 is installed in the installation case 150, a part of the liquid chamber 210 and a part of the liquid chamber 171 overlap each other when viewed in the horizontal direction. As a result, the ink stored in the liquid chamber 210 moves to the liquid chamber 171 of the tank 160 due to a water head difference through the connected supply tube 230 and the joint 180.

As illustrated in FIG. 4, a projection 241 is formed on the upper wall 204. The projection 241 protrudes upward from the outer surface of the upper wall 204 and extends in the front and back direction 8. The projection 241 includes a lock surface 242 and an inclined surface 243. The lock surface 242 and the inclined surface 243 are located above the upper wall 204. The lock surface 242 is directed to the front side in the front and back direction 8 and extends in the up and down direction 7 and the left and right direction 9 (that is, being substantially orthogonal to the upper wall 204). The inclined surface 243 is inclined with respect to the upper wall so as to be directed upward in the up and down direction 7 and backward in the front and back direction 8.

The lock surface 242 is a surface to be brought into contact with the lock pin 156 in the state where the cartridge 200 is installed in the installation case 150. The inclined surface 243 is a surface for guiding the lock pin 156 to a position where the lock pin comes in contact with the lock surface 242 in the course of installing the cartridge 200 on the installation case 150. In the state where the lock surface 242 and the lock pin 156 are in contact with each other, the cartridge 200 is held at the installation position illustrated in FIG. 5 against the urging force of the coil springs 186, 223, and 233.

A flat plate-like member is formed in front of the lock surface 242 so as to extend upward from the upper wall 204. An upper surface of the flat plate-like member corresponds to an operation portion 244 to be operated by a user when the cartridge 200 is removed from the installation case 150. When the cartridge 200 is installed in the installation case 150 and the cover 87 is located at the exposing position, the operation portion 244 can be operated by the user. When the operation portion 244 is pushed downward, the cartridge 200 rotates, and thus the lock surface 242 moves downward from the lock pin 156. As a result, the cartridge 200 can be removed from the installation case 150.

The light shielding rib 245 is formed on the outer surface of the upper wall 204 and behind the projection 241. The light shielding rib 245 protrudes upward from the outer surface of the upper wall 204 and extends in the front and back direction 8. The light shielding rib 245 is formed of a material or color that shields the light output from the light emitting portion of the installation sensor 154. The light shielding rib 245 is located on an optical path extending from the light emitting portion to the light receiving portion of the installation sensor 154 in the state where the cartridge 200 is installed in the installation case 150. That is, the installation sensor 154 outputs a low-level signal to the controller 130 when the cartridge 200 is installed in the installation case 150. On the other hand, the installation sensor 154 outputs a high-level signal to the controller 130 when the cartridge 200 is not installed in the installation case 150. That is, the controller 130 can detect whether the cartridge 200 is installed in the installation case 150, depending on a signal output from the installation sensor 154.

An IC substrate 247 is located on the outer surface of the upper wall 204 and between the light shielding rib 245 and the projection 241 in the front and back direction 8. On the IC substrate 247, an electrode 248 is formed. In addition, the IC substrate 247 includes a memory (not illustrated). The electrode 248 is electrically connected to the memory of the IC substrate 247. The electrode 248 is exposed on an upper surface of the IC substrate 247 so as to be electrically connectable with the contact 152. That is, the electrode 248 is electrically connected to the contact 152 in the state where the cartridge 200 is installed in the installation case 150. The controller 130 can read information from the memory of the IC substrate 247 through the contact 152 and the electrode 248, and can write information to the memory of the IC substrate 247 through the contact 152 and the electrode 248.

The memory of the IC substrate 247 stores an ink amount Vc and identification information for identifying the individual of the cartridge 200. An initial ink amount Vc0 is stored, as the ink amount Vc, in the memory of the IC substrate 247 of a new cartridge 200. The initial ink amount Vc0 is an example of the maximum liquid amount indicating the maximum amount of ink that can be stored in the cartridge 200. In other words, the initial ink amount Vc0 indicates the amount of ink stored in the new cartridge 200. Hereinafter, information stored in the memory of the IC substrate 247 may be collectively referred to as "CTG information" in some cases. Further, the "new" is a so-called unused item and indicates a state in which the ink stored in the cartridge 200 has never flowed out from the cartridge 200 which is manufactured and sold.

A storage region of the memory of the IC substrate 247 includes, for example, a region where information is not overwritten by the controller 130 and a region where information can be overwritten by the controller 130. For example, identification information is stored in the non-overwritable region that is not overwritten, and the ink amount Vc is stored in the overwritable region.

(Controller)

As illustrated in FIG. 6, the controller 130 includes a CPU 131, a ROM 132, a RAM 133, an EEPROM 134, and an ASIC 135. The ROM 132 stores various programs that allow the CPU 131 to control various operations. The RAM 133 is used as a storage region which temporarily records data or signals to be used when the CPU 131 executes the programs or a work region where data is processed. The EEPROM 134 stores setting information which should be retained even after the power is turned off. The ROM 132, the RAM 133, and the EEPROM 134 are examples of memories.

The ASIC 135 is used to operate the feed roller 23, the conveyance roller 25, the discharge roller 27, and the head 21. The controller 130 rotates the feed roller 23, the conveyance roller 25, and the discharge roller 27 by driving a motor (not illustrated) through the ASIC 135. In addition, the controller 130 outputs a driving signal to a driving element of the head 21 through the ASIC 135, thereby causing the head 21 to discharge ink through the nozzle 29. The ASIC 135 can output a plurality types of driving signals depending on the amount of ink to be discharged through the nozzle 29.

Further, a display 17 and an operation panel 22 are connected to the ASIC 135. The display 17 is a liquid crystal display, an organic EL display, or the like, and includes a display screen on which various types of information are displayed. The display 17 is an example of an alarm. However, specific examples of the alarm are not limited to the display 17, and may include a speaker, an LED lamp, or a combination thereof. The operation panel 22 outputs an operation signal corresponding a user's operation to the controller 130. For example, the operation panel 22 may include a push button, or may include a touch sensor overlaid on the display 17.

Further, the ASIC 135 is connected with the contact 152, the cover sensor 88, the installation sensor 154, and the liquid level sensor 155. The controller 130 accesses the memory of the IC substrate 247 of the cartridge 200 installed in the installation case 150 through the contact 152. The controller 130 detects the position of the cover 87 through the cover sensor 88. In addition, the controller 130 detects insertion and removal of the cartridge 200 through the installation sensor 154. Further, the controller 130 detects through the liquid level sensor 155 whether the liquid level of the ink stored in the liquid chamber 171 is equal to or higher than the predetermined position P.

When liquid level sensor 155 outputs a high-level signal, the ROM 132 stores a predetermined ink amount Vsc stored in the liquid chamber 171 of the tank 160 and a predetermined ink amount Vcc stored in the liquid chamber of the cartridge 200. The predetermined ink amount Vcc is zero in the exemplary embodiment.

The EEPROM 134 stores various types of information in correlation with four cartridges 200 installed in the installation case 150, namely, in correlation with the tanks 160 communicating with the cartridges 200. The various types of information includes, for example, ink amounts Vc and Vs which are examples of the liquid amount, a function F, a C_Empty flag, an S_Empty flag, a temporary canceling flag, a in-tank non-residual amount flag, a count value SN1, a count value SN2, a count value TN, a threshold $N_{th1}$, a threshold $N_{th2}$, a threshold Vmin, and a waiting time Tw.

The ink amount Vc and the identification information are information read by the controller 130 from the memory of the IC substrate 247 through the contact 152 in a state where the cartridge 200 is installed in the installation case 150. The function F may be stored in the ROM 132 instead of the EEPROM 134. The initial ink amount Vc0 is an example of initial information.

The ink amount Vc indicates the amount of ink stored in the liquid chamber 210 of the cartridge 200. The ink amount Vs indicates the amount of ink stored in the liquid chamber 171 of the tank 160. The ink amounts Vc and Vs are calculated by the function F. The function F is information indicating a corresponding relation of the total amount Vt of ink, the ink amount Vc, and the ink amount Vc. The ink in the liquid chamber 210 of the cartridge 200 and the ink in the liquid chamber 171 of the tank 160 are in equilibrium in a state where positions in the vertical direction 7 of the liquid levels of the respective inks coincide with each other. That is, in the equilibrium state, the movement of the ink between the liquid chamber 210 and the liquid chamber 171 is stopped. For example, the relation between the total amount Vt of ink and ink amount Vs can be approximated by the function F. Accordingly, when the total amount Vt of ink is calculated, the ink amount Vs and the ink amount Vc are obtained. The ink amount Vs and the ink amount Vc are not limited to the form of the function F, and may be obtained by a table correlated with the total amount Vt.

The count value SN1 is a value equivalent to an ink discharge amount Dh (that is, the ink amount indicated by the driving signal) instructed to be discharged from the head 21 and is a value that is updated closer to the threshold $N_{th1}$, after the signal output from the liquid level sensor 155 changes from the low-level signal to the high-level signal. The count value SN1 is a value counted up with an initial value being "0". In addition, the threshold $N_{th1}$ is equivalent to a volume of the liquid chamber 171 between the vicinity of the upper end of the outflow port 174 and the predetermined position P. However, the count value SN1 may be a value counted down with a value equivalent to the volume as an initial value. In this case, the threshold $N_{th1}$ is zero (0). The count value SN1 is an example of a first count value. The threshold $N_{th1}$ is an example of a first threshold.

When the S_Empty flag is "OFF" and the signal output from the liquid level sensor 155 is a high-level signal, the count value SN2 is a value equivalent to an ink discharge amount Dh (that is, the ink amount indicated by the driving signal) instructed to be discharged from the head 21 and is a value that is updated closer to the threshold $N_{th2}$. The count value SN2 is a value counted up with an initial value being "0". Further, the threshold $N_{th2}$ is a value equivalent to the product of the average amount of ink discharged from the head 21 and the number of unit sheets that can be image-recorded within the waiting time Tw (to be described below) in the image recording on the unit sheet (one sheet). However, the count value SN2 may be a value counted down with a value equivalent to the product as an initial value. In this case, the threshold $N_{th2}$ is zero (0). The count value SN2 is an example of a second count value. The threshold $N_{th2}$ is an example of a second threshold. In the exemplary embodiment, the threshold $N_{th1}$ is larger than the threshold $N_{th2}$. However, the magnitude relation between the threshold $N_{th1}$ and the threshold $N_{th2}$ is set depending on the size of the liquid chamber 171 of the tank 160, an inflow rate from the liquid chamber 210 of the cartridge 200 to the liquid chamber 171, and the height at which the liquid level sensor 155 detects the liquid level of the ink.

The count value TN is a value equivalent to an ink discharge amount Dh (that is, the ink amount indicated by the driving signal) instructed to be discharged from the head 21 and is a value counted up with an initial value being "0", after the signal output from the liquid level sensor 154 changes from the high-level signal to the low-level signal. Further the count value TN may be a value counted down with a value equivalent to the total amount Vt of ink as an initial value.

The C_Empty flag is information indicating whether the cartridge 200 is in a cartridge empty state. In the C_Empty flag, a value "ON" corresponding to the cartridge empty state or a value "OFF" corresponding to non-cartridge empty state is set. The cartridge empty state is a state where ink is not substantially stored in the cartridge 200 (more specifically, the liquid chamber 210). In other words, the cartridge empty state is a state where ink does not move from the liquid chamber 210 to the liquid chamber 171 communicating with the cartridge 200. Namely, the cartridge empty state is a state where the liquid level of the tank 160 communicating with the cartridge 200 is lower than the predetermined position P.

The S_Empty flag is information indicating whether the tank 160 is in an ink empty state. In the S_Empty flag, a value "ON" corresponding to the ink empty state or a value "OFF" corresponding to non-ink empty state is set. The ink empty state is, for example, a state where the liquid level of the ink stored in the tank 160 (more specifically, the liquid chamber 171) reaches the position of the upper end of the outflow port 174. In other words, the ink empty state is a state where the count value SN1 is equal to or larger than the threshold $N_{th1}$. When the ink is continuously discharged from the head 21 after the ink empty state, the liquid level of the ink in the tank 160 may fall below the upper end of the outflow port 174, and air may be mixed in an ink flow path from the tank 160 to the head 21 or in the head 21 (so called air-in). As a result, the inside of the nozzle 29 is filled with the ink, and the ink may not be discharged.

The temporary canceling flag is information indicating whether the signal output from the liquid level sensor 155 is changed from the high-level signal after both the C_Empty flag and the S_Empty flag are set to "OFF" after the cartridge 200 is exchanged. The temporary canceling flag is set to a value "ON" corresponding to a state where the signal output from the liquid level sensor 155 is in the high-level signal or a value "OFF" corresponding to a state where the signal is changed to the low-level signal. In the temporary canceling state, if the discharge of ink continues through the head 21 while the signal output from the liquid level sensor 155 remains as the high-level signal, the air-in may occur as described above.

The in-tank non-residual amount flag is information indicating whether the liquid level of the ink stored in the liquid chamber 171 of the tank 160 is descending to the upper end of the outflow port 174. When the liquid level of the ink stored in the liquid chamber 171 reaches a position near the upper end of the outflow port 174, the tank is in an ink empty state. The ink empty state is determined depending on whether the count value SN1 is equal to or larger than the threshold $N_{th1}$. However, the position of the liquid level of the ink stored in the liquid chamber 171 in the ink empty state is preferably set to be somewhat higher than the upper end of the outflow port 174 in consideration of the error of the count value SN1 and the position of the liquid level of the ink stored in the liquid chamber 171 due to the installation state (inclination from the horizontal) of a multifunction machine 10.

On the other hand, when the total amount Vt, which is the sum of the ink amount Vc stored in the exchanged cartridge 200 and the ink amount Vs stored in the liquid chamber 171 of the tank 160 is equal to or larger than the threshold Vmin, the ink moves from the liquid chamber 210 to the liquid chamber 171, and the liquid level of the ink in the liquid chamber 171 reaches the predetermined position P as a predetermined time has elapsed. In the predetermined time until when the liquid level of the ink reaches the predetermined position P, even if the ink does not move from the liquid chamber 210 to the liquid chamber 171, when the image recording is performed only on the number N of sheets described above with the amount of ink necessary for the number N of sheets on which the image recording can be performed, if the position of the liquid level of the ink store in the liquid chamber 171 in the ink empty state is set above the upper end of the outflow port 174, the liquid level of the ink stored in the liquid chamber 171 does not reach the upper end of the outflow port 174.

However, since the image recording is previously performed only on the number N of sheets described above in the temporary canceling state, if the fully canceling is not performed thereafter, even when the cartridge 200 is exchanged again thereafter, the position of the liquid level of the ink stored in the liquid chamber 171 may already descend near the upper end of the outflow port 174. From such a state, when the discharge of ink from the head 21 continues, the air-in occurs as described above. The "OFF"

of the in-tank non-residual amount flag is an example of a first value, and the "ON" is an example of a second value.

(Operation of Printer)

An operation of the printer 10 according to the exemplary embodiment will be described with reference to FIGS. 7 to 10. Each of processes illustrated in FIGS. 7 to 10 is executed by the CPU 131 of the controller 130. Each of the following processes may be executed by the CPU 131 reading programs stored in the ROM 132, or may be implemented a hardware circuit mounted on the controller 130. Further, execution orders of the following processes can be appropriately changed within the scope of the disclosure.

(Image Recording Process)

Figure 7:
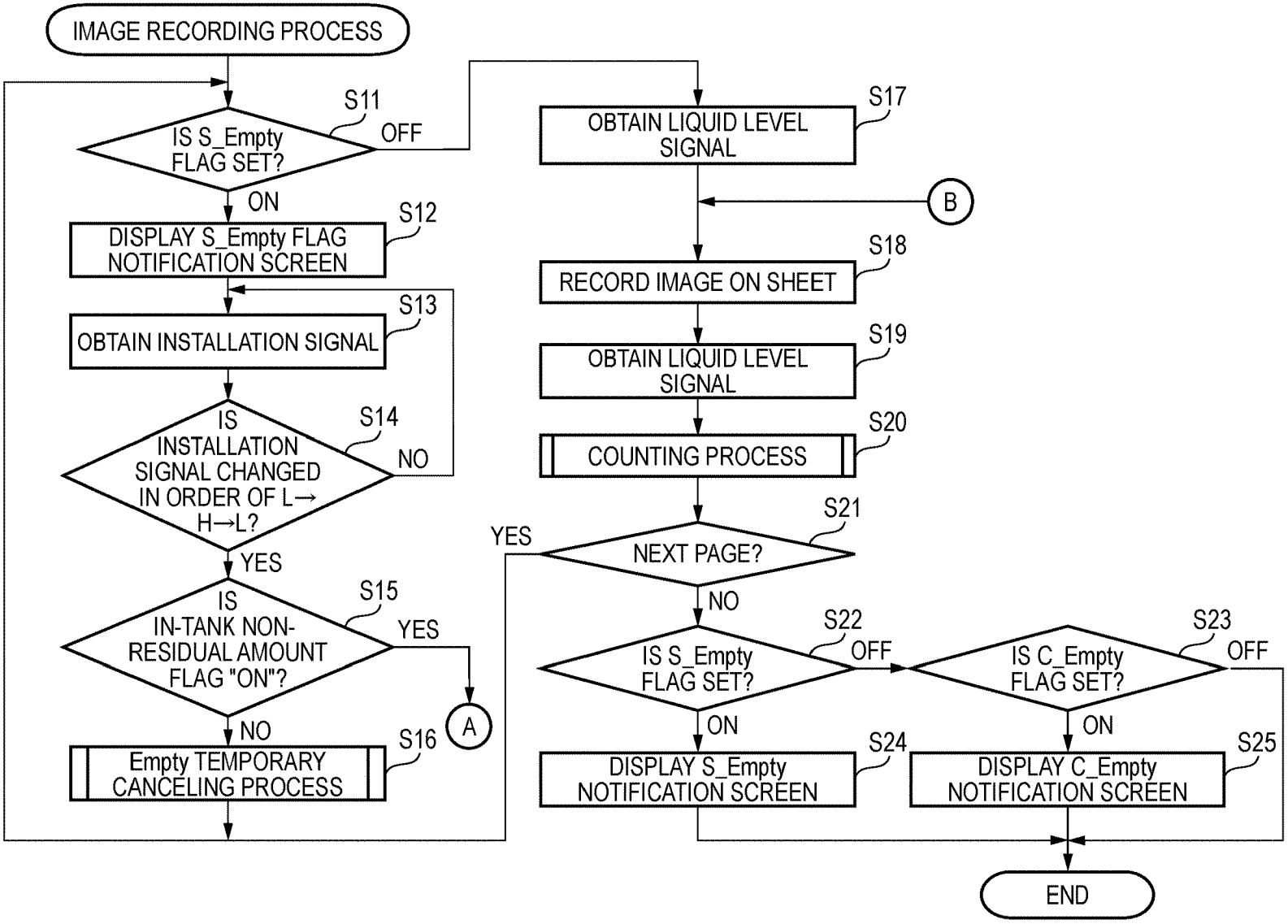
FIG. 7 is a flowchart of an image recording process.

The controller 130 executes an image recording process illustrated in FIG. 7 in response to a recording instruction being input to the printer 10. The recording instruction is an example of a discharge instruction for causing the printer 10 to execute a recording process of recording an image indicated by image data on a sheet. An acquisition destination of the recording instruction is not particularly limited, but, for example, a user's operation corresponding to the recording instruction may be received through the operation panel 22 or may be received from an external device through a communication interface (not illustrated).

First, the controller 130 determines set values of four S_Empty flags (S11). Then, the controller 130 displays an S_Empty notification screen on the display 17 in response to determining that at least one of the four S_Empty flags is set to "ON" (S11: ON) (S12). The S_Empty notification screen is a screen for notifying the user that the corresponding tank 160 has entered the ink empty state. For example, the S_Empty notification screen may include information relating to the color and the ink amounts Vc and Vs of the ink stored in the tank 160 being in the ink empty state. In step S12, the controller 130 may display the C_Empty notification screen on the display 17 together with the S_Empty notification screen in response to determining that at least one of the four C_Empty flags is set to "ON". The operation of the display 17 in S12 is an example of a first notification.

In addition, the controller 130 executes processes S13 to S15 for each the cartridge 200 corresponding to the S_Empty flag set to "ON". That is, the processes is executed for each the cartridge 200 among the four cartridges 200 in which the S_Empty flag is set to "ON". Since the processes S13 to S15 for each the cartridge 200 is common, only the processes S13 to S15 corresponding to one cartridge 200 will be described.

First, the controller 130 obtains a signal output from the installation sensor 154 (S13). Next, the controller 130 determines whether the signal obtained from the installation sensor 154 is a high-level signal or a low-level signal (S14). Then, the controller 130 repeatedly executes the processes S13 and S14 at predetermined time intervals until the signal output from the installation sensor 154 changes into the high-level signal from the low-level signal and changes into the low-level signal from the high-level signal again (S14: No). In other words, the controller 130 repeatedly executes the processes S13 and S14 until the cartridge 200 is removed from the installation case 150 and a new cartridge 200 is installed in the installation case 150.

Then, the controller 130 obtains the high-level signal from the installation sensor 154 after obtaining the low-level signal from the installation sensor 154, and then executes the high-level signal from the installation sensor 154 (S14: Yes). In response to obtaining the low-level signal from the installation sensor 154 thereafter, it is determined whether in-tank non-residual amount flag is "ON" (S15). The controller 130 executes the following process (see FIG. 11) when the in-tank non-residual amount flag is "ON" (S15: Yes). In addition, the controller 130 obtains the high-level signal from the installation sensor 154, and then stores the time, at which the low-level signal is obtained from the installation sensor 154, in the EEPROM 134. The controller 130 may measure the time by operating a timer after obtaining the low-level signal from the installation sensor 154, instead of storing the time. The stored time or the measured time is used in an Empty fully canceling process which will be described below.

The controller 130 executes an Empty temporary canceling process (S16) when the in-tank non-residual amount flag is "OFF" (S15: No). The Empty temporary canceling process is a process of deleting the C_Empty notification screen and the S_Empty notification screen displayed on the display 17. The details of the Empty temporary canceling process will be described with reference to FIG. 9. Then, the steps subsequent to S11 are executed again in response to the completion of the Empty temporary canceling process.

The controller 130 obtains signals output from four liquid level sensors 155 at the present time when all the S_Empty flags corresponding to all the cartridges 200 are not "ON", that is, are "OFF" (S17). In S17, the controller 130 further causes the RAM 133 to store information indicating whether the signal obtained from the liquid level sensor 155 is a high-level signal or a low-level signal.

Then, the controller 130 records the image indicated by the image data included in the recording instruction on the sheet (S18). More specifically, the controller 130 causes the sheet on the feed tray 15 to be conveyed to the feed roller 23 and the conveyance roller 25, causes the head 21 to discharge the ink, and causes one sheet, on which the image is recorded, to be discharged to the discharge roller 27 via the discharge tray 16. That is, the controller 130 permits the discharge of the ink through the head 21 when all of the four S_Empty flags are set to "OFF". Meanwhile, the controller 130 prohibits the discharge of the ink through the head 21 when at least one of the four S_Empty flags is set to "ON".

Next, the controller 130 obtains signals output from the four liquid level sensors 155 at the present time in response to recording the image on one sheet according to the recording instruction (S19). Further, similarly to step S17, the controller 130 causes the RAM 133 to store information indicating whether the signal obtained from the liquid level sensor 155 is a high-level signal or a low-level signal (S19). Then, the controller 130 executes a counting process (S20). The counting process is a process of updating the count values TN, SN1, and SN2, the C_Empty flag, and the S_Empty flag based on the signal obtained from the liquid level sensor 155 in steps S17 and S19. Details of the counting process will be described below with reference to FIG. 8.

Next, the controller 130 repeatedly executes the processes S11 to S20 until all the images indicated by the recording instruction are recorded on the sheet (S21: Yes). Then, the controller 130 determines set values of the four S_Empty flags and set values of the four C_Empty flags in response to recording all the images indicated by the recording instruction on the sheet (S21: No) (S22 and S23).

When at least one of the four S_Empty flags is set to "ON" (S22: ON), the controller 130 displays the S_Empty notification screen on the display 17 (S24). In addition, when all of the four S_Empty flags are set to "OFF" and at least one of the four C_Empty flags is set to "ON" (S22: OFF & S23: ON), the controller 130 displays the C_Empty notification screen on the display 17 (S25). The processes S24 and S25 are examples of operating the alarm.

The S_Empty notification screen displayed in step S24 may be the same as in step S12. In addition, the C_Empty notification screen is a screen for informing the user that the cartridge 200 corresponding to the C_Empty flag set to "ON" has entered the cartridge empty state. For example, the C_Empty notification screen may include information related to the color and the ink amounts Vc and Vs of the ink stored in the cartridge 200 being in the cartridge empty state. On the other hand, when all of the four S_Empty flags and the four C_Empty flags are set to "OFF" (S23: OFF), the controller 130 completes the image recording process without executing the processes S24 and S25.

A specific example of the discharge instruction is not limited to the recording instruction, but may be a maintenance instruction instructing maintenance of the nozzle 29 such as a purge. For example, the controller 130 executes the same processes as in FIG. 7 in response to obtaining the maintenance instruction through the operation panel 22. Differences from the above-described processes in the case of obtaining the maintenance instruction are as follows. First, the controller 130 drives a maintenance mechanism (not illustrated) in step S18, and discharges the ink through the nozzle 29. In addition, the controller 130 executes the processes of step S21 and the subsequent steps without executing step S21 after executing the counting process.

(Counting Process)

Figure 8:
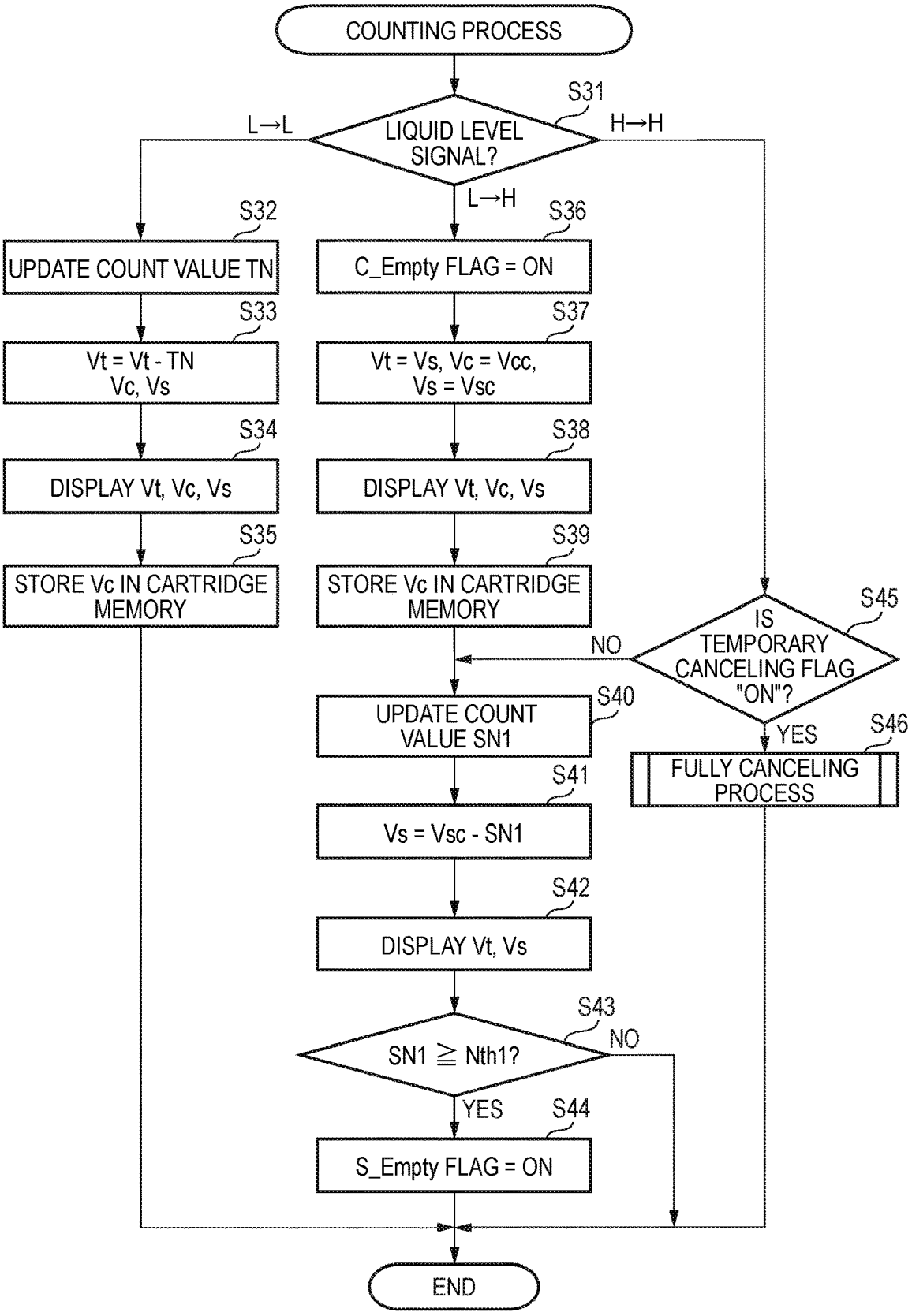
FIG. 8 is a flowchart of a counting process.

Next, details of the counting process executed by the controller 130 in S20 will be described with reference to FIG. 8. The controller 130 independently executes the counting process with respect to each of the four cartridges 200. Since the counting process is common for each cartridge 200, only the counting process corresponding to one cartridge 200 will be described.

First, the controller 130 compares information indicating the signals of the liquid level sensors 155 stored in the RAM 133 in S17 and S19 with one another (S31). That is, the controller 130 determines a change in the signal of each of the four liquid level sensors 155 before and after the process of S19 is executed immediately before the counting process (S20) is executed.

The controller 130 executes the residual amount updating process in response to the fact (S31: L→L) that the information stored in the RAM 133 in steps S17 and S19 indicates the low-level signal (that is, there is no change in the output of the liquid level sensors 155 before and after the process of S19) (S32). That is, the controller 130 counts up the count value TN which is a value equivalent to the amount of ink instructed to be discharged in the previous step S18.

In addition, the controller 130 calculates the current total amount Vt (S33). First, the controller 130 calculates the total amount Vt of the exchanged cartridge which is the sum of the ink amount Vc and the ink amount Vs stored in the EEPROM 134 after exchange of the cartridge. Then, the controller 130 calculates the current total amount Vt (Vt=Vt−TN) which is a value obtained by subtracting the ink amount equivalent to the count value TN from the calculated total amount Vt. Then, the controller 130 obtains the ink amounts Vc and Vs based on the calculated current total amount Vt and the function F (S33).

Then, the controller 130 displays the obtained total amount Vt and one of the ink amount Vc and the ink amount Vs on the display 17 (S34). Further, the controller 130 overwrites the obtained ink amount Vc with the ink amount Vc stored in the memory of the IC substrate 247 of the cartridge 200 (S35).

Figure 12A:
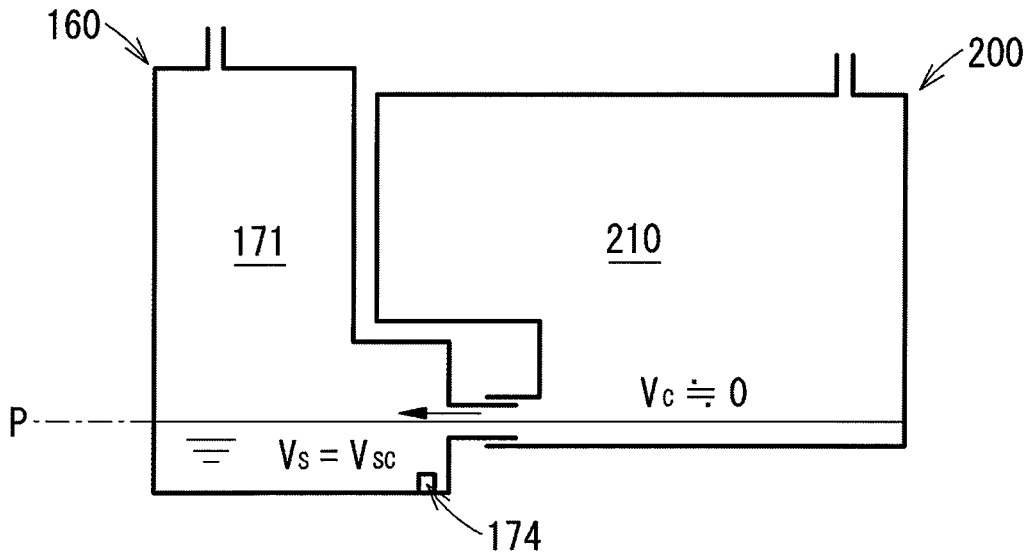
FIG. 12A is a schematic view illustrating a state where a cartridge communicates with a tank and illustrates a state where a cartridge is empty.

Further, the controller 130 substitutes "ON" for the C_Empty flag in response to the fact (S31: L→H) that the information stored in the RAM 133 in S17 indicates the low-level signal and the information stored in the RAM 133 in S19 indicates the high-level signal (that is, there is change in the output of the liquid level sensors 155 before and after the process of S18) (S36). The change from the low-level signal into the high-level signal in the output of the liquid level sensors 155 corresponds to the fact that the liquid level of the liquid chamber 171 reaches the predetermined position P during the process of S18 as illustrated in FIG. 12A. Then, there is no ink movement between the cartridge 200 and the tank 160.

In addition, the controller 130 reads a predetermined ink amount Vcc (=0) from the ROM 132, and sets the ink amount Vc to the predetermined ink amount Vcc (S37). Similarly, the controller 130 reads a predetermined ink amount Vsc (corresponding to the volume of the liquid chamber 171 below the predetermined position P) from the ROM 132, and sets the ink amount Vs to the predetermined ink amount Vsc (S37). Since the ink amounts Vc and Vs calculated in the residual amount updating process include errors, the controller 130 sets the ink amount Vc to the predetermined ink amount Vcc at the timing when the output of the liquid level sensor 155 changes from the low-level signal to the high-level signal, and sets the ink amount Vs to the predetermined ink amount Vsc, thereby resetting the accumulated errors. Further, the controller 130 calculates the current total amount Vt as a value equal to the ink amount Vs (Vt=Vsc) (S37). As the ink amount Vc becomes zero, the total amount Vt has the same value as the ink amount Vs.

Then, the controller 130 displays the current total amount Vt and one of the ink amount Vc and the ink amount Vs on the display 17 (S38). In addition, the controller 130 overwrites the above-described ink amount Vc with the ink amount Vc stored in the memory of the IC substrate 247 of the cartridge 200 (S39).

Since the change in the output of the liquid level sensors 155 is in the middle of the process of S18, the predetermined ink amount Vsc read in step S37 is not strictly the amount of ink stored in the tank 160 at the moment the output of the liquid level sensor 155 changes, but indicates the amount of ink immediately before the output of the liquid level sensor 155 changes. However, since the difference in the ink amount is small, the ink amount Vsc read in step S37 is approximately treated as the ink amount Vs at the time when the output of the liquid level sensor 155 changes.

In addition, the controller 130 counts up the count value SN1 stored in EEPROM 134 with the value corresponding to the amount of ink instructed to be discharged in the immediately previous step S17 (S40). In other words, the controller 130 starts to update the count value SN1 in response to the change from the low-level signal into the high-level signal in the output of the liquid level sensors 155. The controller 130 counts up the count value TN stored in the EEPROM 134 with a value corresponding to the amount of ink instructed to be discharged in the immediately previous step S18.

Then, the controller 130 calculates the ink amount Vs (S41). The above-described ink amount Vs is a value obtained by subtracting from the ink amount corresponding to the count value SN1 stored in the EEPROM 134 from the predetermined ink amount Vsc stored in the ROM 132. As described above, after the output of the liquid level sensor 155 becomes the high-level signal, the ink amount Vs is the same value as the current total amount Vt. In addition, the ink amount Vc is zero.

Then, the controller 130 displays one of the obtained current total amount Vt and the ink amount Vs on display 17 (S42). Since the ink amount Vc is zero after the output of liquid level sensor 155 becomes the high-level signal, the controller 130 does not need to overwrite the ink amount Vc stored in the memory of the IC substrate 247 of the cartridge 200.

Next, the controller 130 compares the count value SN1 updated in step S40 with the threshold value $N_{th1}$ (S43). When it is determined that the count value SN1 updated in step S40 is smaller than the threshold value $N_{th1}$ (S43: No), the controller 130 ends counting process. On the other hand, when it is determined that the count value SN1 updated in step S40 is equal to or more than the threshold value $N_{th1}$ (S43: Yes), the controller 130 puts "ON" into the S_Empty flag (S44). Then, the controller 130 prohibits the discharge of the ink through the head 21 and completes the counting process when the S_Empty flag is set to "ON".

Furthermore, the controller 130 determines whether the temporary canceling flag stored in the EEPROM 134 is "ON" in response to the fact (S31: H→H) that both information stored in the RAM 133 in steps S17 and S19 indicates the high-level signal. The controller 130 reads the count value SN1 stored in the EEPROM 134 when the temporary canceling flag is "ON" (S45: No). Then the controller 130 counts up the read count value SN1 with a value corresponding to the amount of ink instructed to be discharged in the immediately previous step S18 and stores the value in the EEPROM 134 again. That is, the controller 130 updates the count value SN1 (S40). The controller 130 also updates the count value TN. Next, the controller 130 executes the process from step S41 to step S44 described above using the count value SN1 updated in step S40.

In addition, the controller 130 executes the Empty fully canceling process (S46) when the temporary canceling flag is "ON" (S45: Yes). Details of the Empty fully canceling process will be described below with reference to FIG. 10.

(Empty Temporary Canceling Process)

Figure 9:
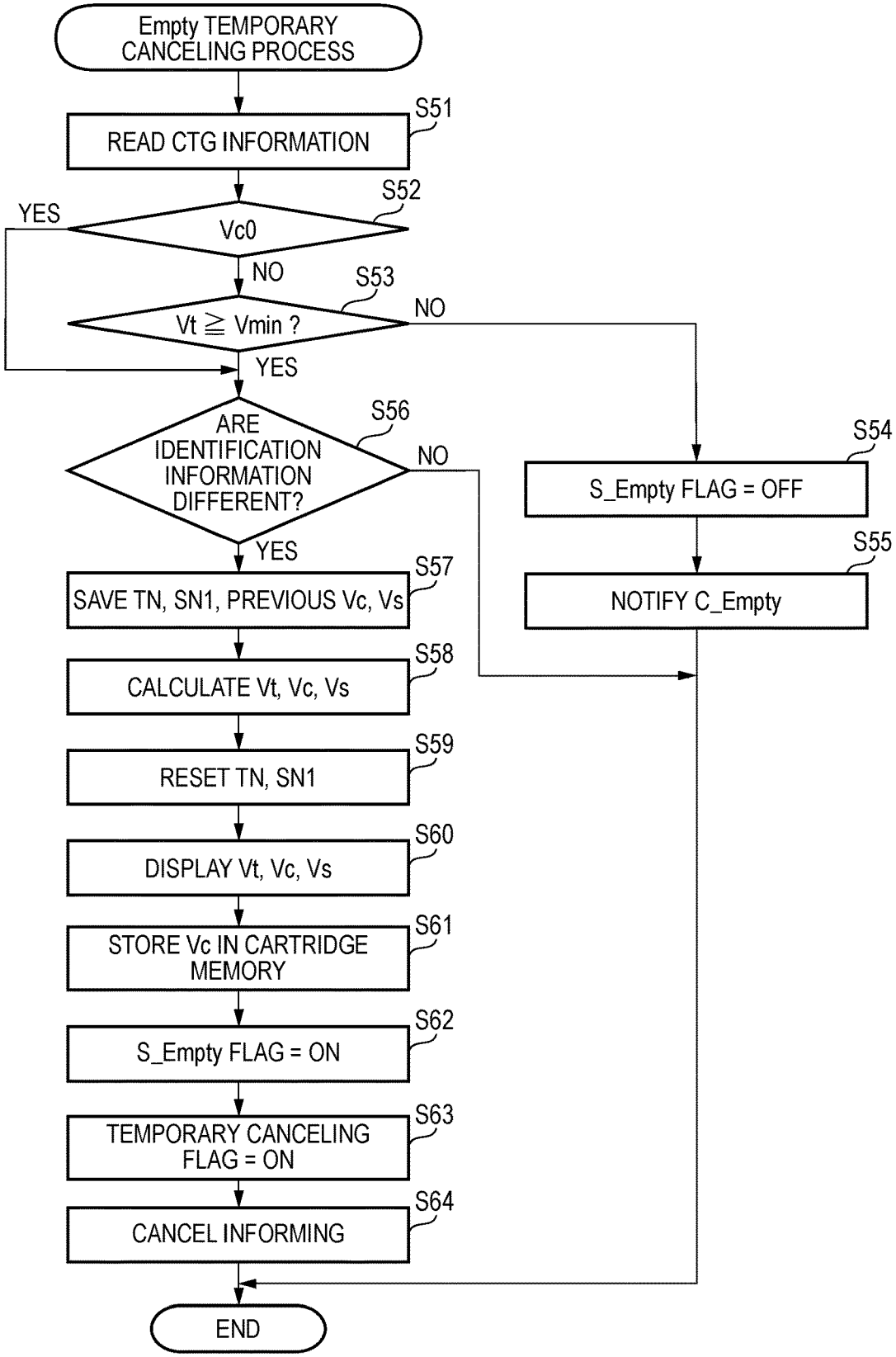
FIG. 9 is a flowchart of an Empty temporary canceling process.

Next, with reference to FIG. 9, details of the Empty temporary canceling process executed by the controller 130 in step S16 will be described. The controller 130 independently executes the Empty temporary canceling process with respect to each of the four cartridges 200. Since the Empty temporary canceling process is common for each cartridge 200, only the Empty temporary canceling process corresponding to one cartridge 200 will be described.

In the counting process, when it is determined that the count value SN1 is equal to or more than the threshold value $N_{th1}$ (S43: Yes), the controller 130 puts "ON" into the S_Empty flag (S44) and prohibits the ink from being discharged through the head 21. In the image recording process, when it is determined that the S_Empty flag is set to "ON" (S11: ON), the controller 130 displays the S_Empty notification screen on the display 17 (S12).

Figure 12B:
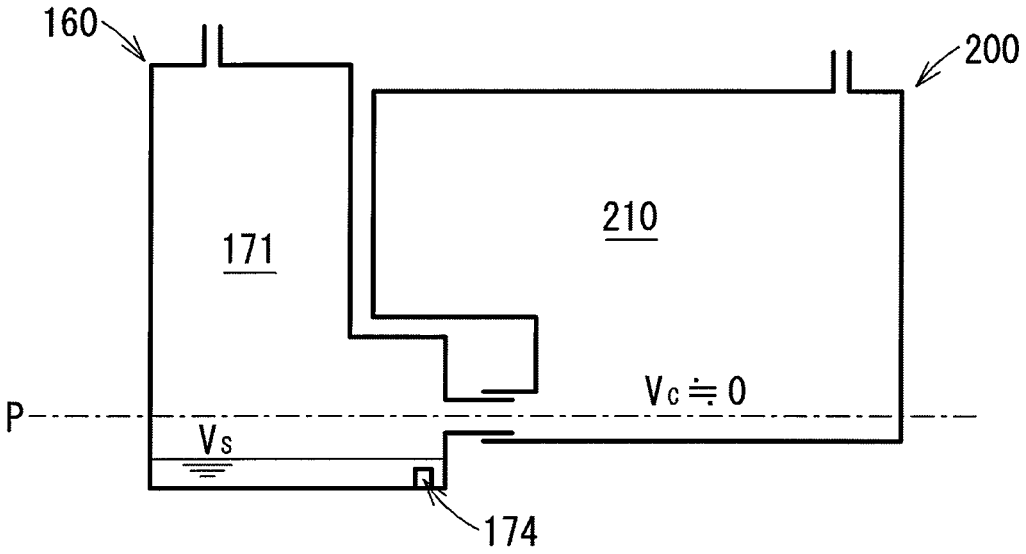
FIG. 12B is a schematic view illustrating a state where a cartridge communicates with a tank and illustrates a state where no residual amount exists in the tank.

In the above-described state (that is, a state where the controller 130 prohibits the ink from being discharged through the head 21 and displays the S_Empty notification screen on the display 17), as illustrated in FIG. 12B, the cartridge 200 is in a state where the ink does not flow toward the tank 160, that is, a state where the ink amount Vc is zero (Vc=0). In addition, the liquid level of the ink in the tank 160 is below the predetermined position P and reaches the position near the upper end of the outflow port 174. Accordingly, when the user does not release the prohibition of the discharge of ink through the head 21 by exchanging the cartridge 200 being in the empty state with a new cartridge or the cartridge 200 in which ink is fully stored, image recording cannot be executed.

In the course of exchanging the cartridge 200 by the user, the controller 130 obtains the low-level signal from the installation sensor 154, then obtains the high-level signal from the installation sensor 154, and further obtains the low-level signal from the installation sensor 154 (S14: Yes). Specifically, in the course of removing the cartridge 200 from the installation case 150, the controller 130 obtains the low-level signal from the installation sensor 154 and then obtains the high-level signal from the installation sensor 154. Next, in the course of inserting the cartridge 200 into the installation case 150, the controller obtains the high-level signal from the installation sensor 154 and then obtains the low-level signal from the installation sensor 154.

In the Empty temporary canceling process, the controller 130 reads CTG information from the memory of the IC substrate 247 through the contact 152 and stores the read CTG information in the EEPROM 134 (S51). In a case where the exchanged cartridge 200 is a new cartridge, an initial ink amount Vc0 is stored as the ink amount Vc in the memory of the IC substrate 247. In addition, identification information is read from the memory of the IC substrate 247.

When it is determined that the initial ink amount Vc0 is read (S52: Yes), the controller 130 does not execute step S53 described later and executes step S56 described later. When it is determined that the initial ink amount Vc0 is not read (S52: No), the controller 130 executes step S53 described later. When the initial ink amount Vc0 is not read, the ink amount Vc read from the memory of the IC substrate 247 is not the initial ink amount Vc0 but a value smaller than the initial ink amount.

The controller 130 compares a total amount Vt obtained by adding the ink amount Vc read from the memory of the IC substrate 247 and the ink amount Vs read from the EEPROM 134 and the threshold value Vmin (S53). The threshold value Vmin corresponds to the total amount when the liquid level reaches the predetermined position P in the liquid chamber 171 of the tank 160. When the calculated total amount Vt is equal to or more than the threshold value Vmin (S53: Yes), the ink moves from the liquid chamber 210 of the cartridge 200 to the liquid chamber 171 of the tank 160 and the liquid level of the ink in the liquid chamber 171 is equal or higher than the predetermined position P. On the other hand, the controller 130 executes steps S54 and S55 when the calculated total amount Vt is smaller than the threshold value Vmin (S53: No).

When it is determined that the calculated total amount Vt is smaller than the threshold value Vmin (S53: No), the controller 130 puts "OFF" to the S_Empty flag and releases the prohibition of discharge of ink through the head 21 (S54). A state where "ON" is put into the C_Empty flag is maintained. Then, the controller 130 erases the S_Empty notification screen from the display 17 and displays the C_Empty notification screen on the display 17 (S55). Then, the controller 130 completes the Empty temporary canceling process.

When the calculated total amount Vt is smaller than the threshold value Vmin, even in a case where the ink moves from the liquid chamber 210 of the cartridge 200 to the liquid chamber 171 of the tank 160, the liquid level of the ink in the liquid chamber 171 does not become equal to or higher than the predetermined position P. Accordingly, image recording can be executed with the ink stored in the liquid chamber 171 of the tank 160 but the necessity of exchange of the cartridge 200 is informed to the user.

When it is determined that the calculated total amount Vt is equal to or more than the threshold value Vmin (S53: Yes), the controller 130 compares the identification information read from the memory of the IC substrate 247 and the identification information read from the memory of the IC substrate 247 of the cartridge 200 before exchange (S56). The identification information read from the memory of the IC substrate 247 of the cartridge 200 before exchange is stored in the EEPROM 134. For example, since the cartridge 200 is exchanged with a new cartridge 200, the compared two types of identification information are different. The identification information is, for example, a serial number of the cartridge 200.

When it is determined that the compared two types of identification information are the same (S56: No), the controller 130 completes the Empty temporary canceling process. Even when the cartridge 200 in which the ink amount Vc of the liquid chamber 210 becomes zero as the ink is consumed is installed in the installation case 150 again, the ink does not move from the liquid chamber 210 of the cartridge 200 to the liquid chamber 171 of the tank 160 and thus Empty does not need to be temporarily canceled.

When it is determined that the compared two types of identification information are different from each other (S56: Yes), the controller 130 stores the count values TN and SN1, the ink amount Vc, and the ink amount Vs stored in the EEPROM 134 in another memory region of the EEPROM 134 (S57). The count values TN and SN1, the ink amount Vc, and the ink amount Vs stored in another memory region of the EEPROM 134 are used when Empty is not fully canceled after Empty is temporarily canceled as described later.

The controller 130 executes step S57 and then calculates the total amount Vt after cartridge exchange (S58). In detail, the controller 130 calculates the ink amount Vs (which is equal to the total amount Vt) before cartridge exchange based on the count value SN1 before cartridge exchange stored in the EEPROM 134 and a predetermined ink amount Vsc stored in the ROM 132 and stores the ink amount in the EEPROM 134. Based on the calculated ink amount Vs and the ink amount Vc read from the IC substrate 247 of the cartridge 200 after exchange, the total amount Vt after cartridge exchange is calculated. That is, the ink amount Vc stored in the liquid chamber 210 of the new cartridge 200 is added to the ink amount Vs stored in the liquid chamber 171 of the tank 160 immediately before the cartridge 200 is exchanged. Accordingly, the controller 130 calculates the sum of the ink amount Vc read from the IC substrate 247 of the exchanged cartridge 200 and the ink amount Vs before cartridge exchange stored in the EEPROM 134 as the total amount Vt (Vt=Vs+Vc). The ink amounts Vc and Vs are calculated from the calculated total amount Vt of ink based on the function F.

The count values TN and SN1 stored in the EEPROM 134 are reset (S59). Thus, the count values TN and SN1 are respectively set to the initial values (herein, zero).

Then, the controller 130 displays the obtained current total amount Vt and one of the ink amount Vc and the ink amount Vs on the display 17 (S60). The controller 130 stores the calculated ink amount Vc in the memory of the IC substrate 247 through the contact 152 (S61). As long as the initial ink amount Vc0 is stored in the memory of the IC substrate 247 as the ink amount Vc, the controller 130 overwrites the ink amount Vc calculated as the initial ink amount Vc0. By further overwriting the ink amount Vc in the memory of the IC substrate 247, it is possible to determine that the cartridge 200 is not a new cartridge. In the manufacturing step, when a flag for indicating that the cartridge 200 is a new cartridge is set to "ON" in the memory of the IC substrate 247 and the cartridge 200 is installed in the installation case 150 even once, the controller 130 puts "OFF" into the flag. Then, the controller 130 may determine that the cartridge 200 is a new cartridge based on the value of the flag.

The controller 130 puts "OFF" into the S_Empty flag and the C_Empty flag, respectively (S62). The controller 130 puts "ON" into the temporary canceling flag (S63). The controller 130 allows the ink to be discharged through the head 21 when all of the four S_Empty flags are set to "OFF". The controller 130 erases the S_Empty notification screen and the C_Empty notification screen from the display 17 (S64) and completes the Empty temporary canceling process.

(Empty Fully Canceling Process)

Figure 10:
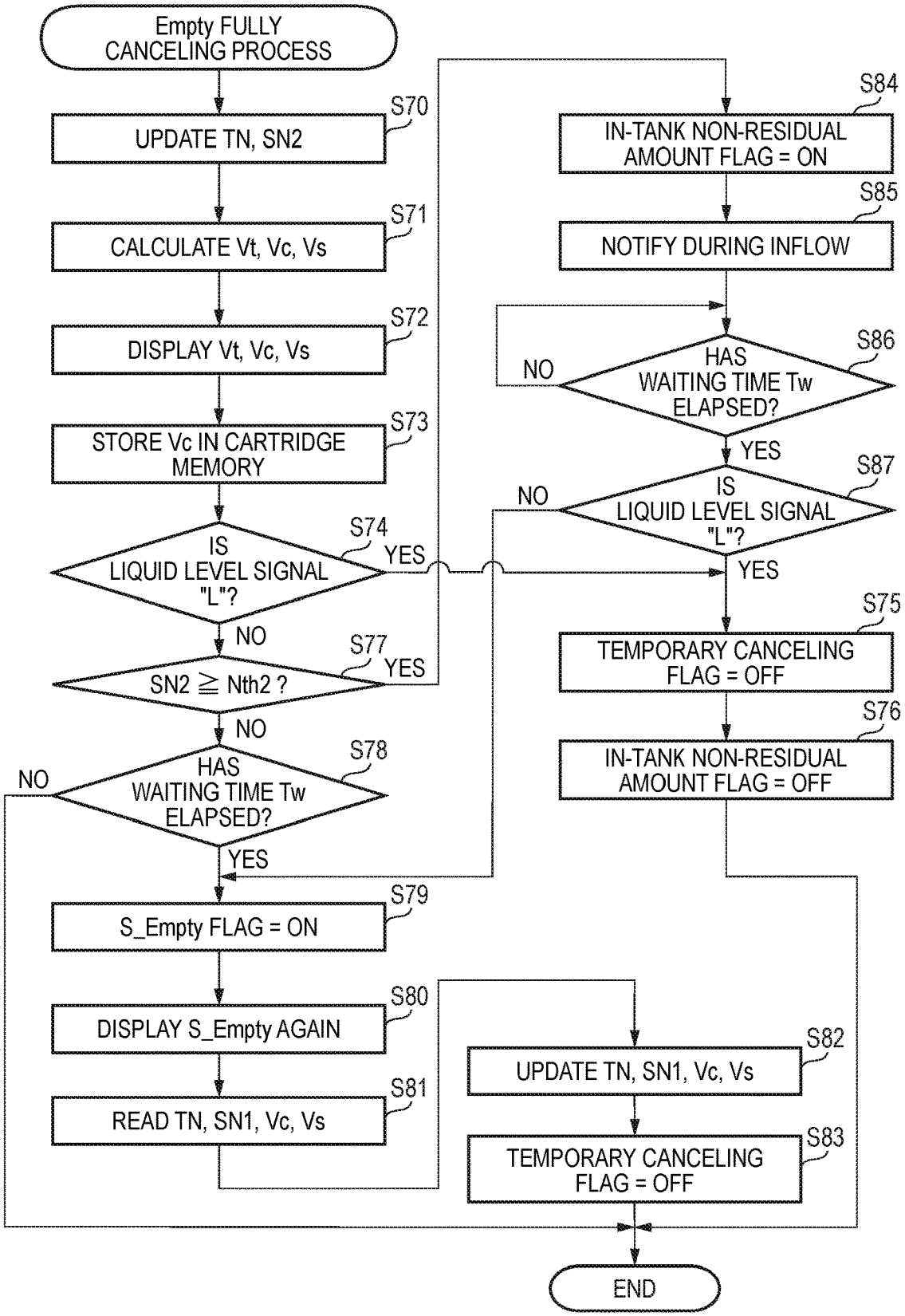
FIG. 10 is a flowchart of an Empty fully canceling process.

Next, with reference to FIG. 10, details of the Empty fully canceling process executed by the controller 130 in step S46 will be described. The controller 130 independently executes the Empty fully canceling process with respect to each of the four cartridges 200. Since the Empty fully canceling process is common for each cartridge 200, only the Empty canceling process corresponding to one cartridge 200 will be described.

In the counting process, when it is determined that the temporary canceling flag is "ON" (S45: Yes), the controller 130 executes the Empty fully canceling process. At this time, the S_Empty flag is "OFF" and the ink is allowed to be discharged through the head 21. The S_Empty notification screen is not displayed on the display 17. Accordingly, the user can use the printer 10 in the same manner as in a normal use state.

Figure 13:
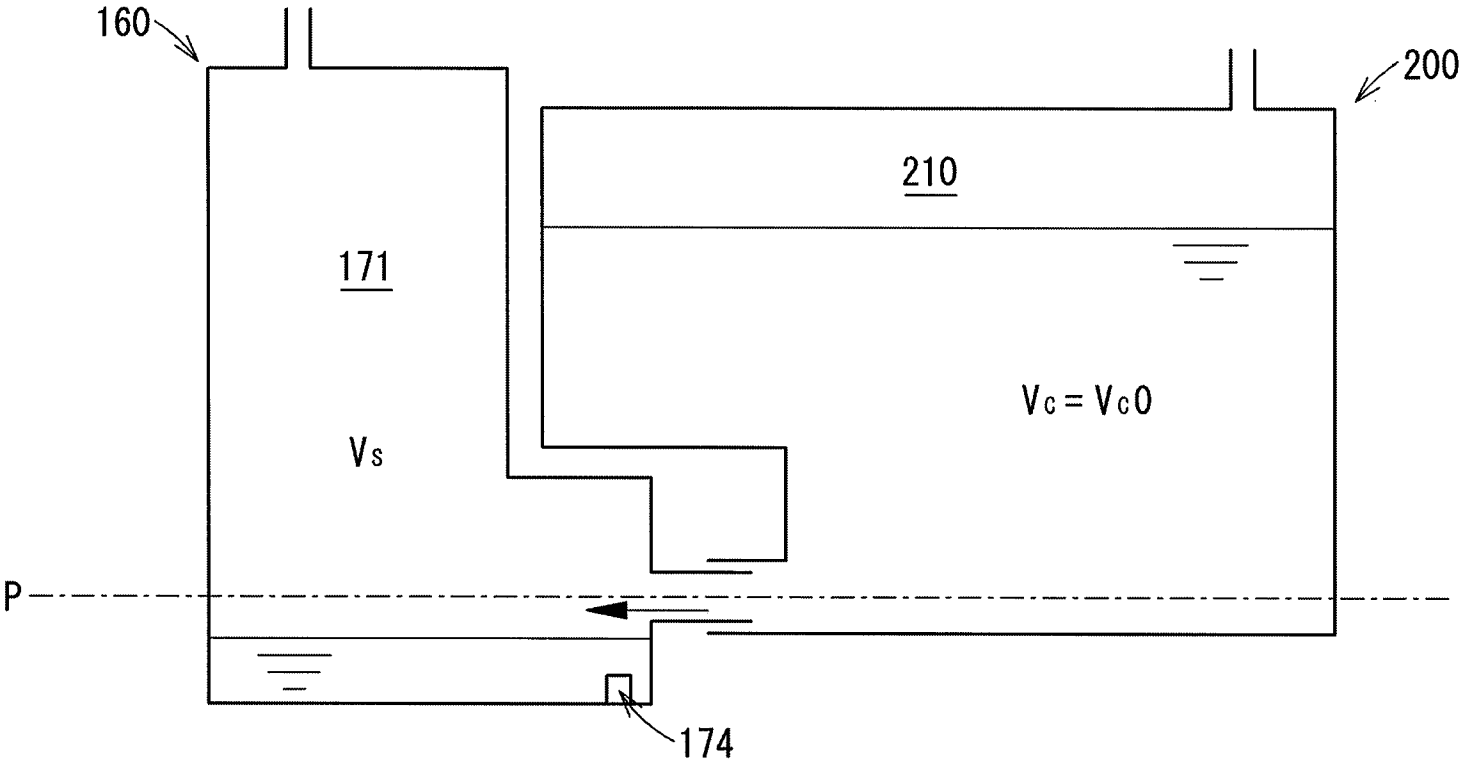
FIG. 13 is a schematic view illustrating a state where the cartridge communicates with the tank and a state until when ink flows out from the cartridge to the tank and a liquid level of the ink in the tank reaches a predetermined position.

As illustrated in FIG. 13, in a state where the temporary canceling flag is "ON", the ink moves from the liquid chamber 211 of the cartridge 200 to the liquid chamber 171 of the tank 160 and the liquid level of the ink in the liquid chamber 171 is lower than the predetermined position P. When the process in step S18 is executed in this state, the controller 130 counts up the count value SN2 stored in the EEPROM 134 with a value corresponding to the amount of ink instructed to be discharged in the immediately previous step S17 (S70). In other words, the controller 130 starts to update the count value SN2 in response to the temporary canceling flag set to "ON". The controller 130 counts up the count value NT stored in the EEPROM 134 with a value corresponding to the amount of ink instructed to be discharged in the immediately previous step S18.

Then, the controller 130 calculates the current total amount Vt (S71). First, the controller 130 calculates the total amount Vt after cartridge exchange as the sum of ink amount Vc and the ink amount Vs stored in the EEPROM 134. Then, the controller 130 calculates the current total amount Vt as a value obtained by subtracting from the total amount Vt after cartridge exchange from the ink amount corresponding to the count value TN. The controller 130 obtains the ink amounts Vc and Vs based on the calculated current total amount Vt and the function F (S71).

Then, the controller 130 displays the obtained current total amount Vt and one of the ink amount Vc or the ink amount Vs on the display 17 (S72). The controller 130 overwrites the obtained ink amount Vc with the ink amount Vc stored in the memory of the IC substrate 247 of the cartridge 200 (S73).

Next, the controller 130 determines that the output of the liquid level sensor 155 is the low-level signal (S74). When it is determined that the output of the liquid level sensor 155 is the high-level signal (S74: Yes), the controller 130 puts "OFF" into the temporary canceling flag and the in-tank non-residual amount flag respectively (S75 and S76).

When it is determined that the output of the liquid level sensor 155 is not the low-level signal, that is, the high-level signal (S74: No), the controller 130 compares the count value SN2 updated in step S70 and a threshold value $N_{th2}$ (S77).

When it is determined that the count value SN2 updated in step S70 is smaller than the threshold value $N_{th2}$ (S77: No), the controller 130 determines whether or not a waiting time Tw elapses from the time (the time when the low-level signal is obtained after the high-level signal is obtained from the installation sensor) stored in the EEPROM 134 in the image recording process (S78). The waiting time Tw is set by a waiting time Tw setting process described later.

The controller 130 completes the Empty fully canceling process when it is determined that the waiting time Tw does not elapse from the time stored in the EEPROM 134 (S78: No).

When it is determined that the waiting time Tw elapses from the time stored in the EEPROM 134 (S78: Yes), the controller 130 puts "ON" into the S_Empty flag (S79). Then, the controller 130 prohibits the ink from being discharged through the head 21 in response to setting the S_Empty flag to "ON". The controller 130 displays the S_Empty notification screen on the display 17 (S80).

In the Empty temporary canceling state, the total amount Vt which is the sum of the ink amount Vc read from the memory of the IC substrate 247 of the exchanged cartridge 200 and the ink amount Vs of the liquid chamber 171 of the tank 160 is equal to or more than the threshold value Vmin. However, if the ink amount Vc stored in the memory of the IC substrate 247 is larger than the amount of ink substantially stored in the cartridge 200 or the movement of ink from the cartridge 200 to the tank 160 is inhibited, the liquid level of the ink is not raised to the predetermined position P in the liquid chamber 171 of the tank 160. In this case, it is preferable that the user is urged to exchange the cartridge 200 with a new cartridge or the cartridge 200 in which ink is fully stored again, and the discharge of ink through the head 21 is prohibited until the cartridge 200 is exchanged again.

The controller 130 reads the count values TN and SN1, the ink amount Vc, and the ink amount Vs stored in another region of the EEPROM 134 (S81) and updates the count values TN and SN1, the ink amount Vc, and the ink amount Vs currently stored in the EEPROM 134 with these values (S82). That is, the count value SN2 is added to the respective count values TN and SN1 stored in another region of the EEPROM 134 and the obtained values are stored in the EEPROM 134. The controller 130 updates the ink amount Vc stored in the EEPROM 134 to zero. The controller 130 puts "OFF" into the temporary canceling flag (S83) and completes the Empty fully canceling process. Thus, the Empty temporary canceling state is ended and an ink empty state immediately before the Empty temporary canceling is set. The updated count value SN1, that is, the sum of the stored count values SN1 and SN2 corresponds to a third count value.

When it is determined that the count value SN2 updated in step S70 is equal to or more than the threshold value $N_{th2}$, (S77: Yes), the controller 130 puts "ON" into the in-tank non-residual amount flag (S84). When the count value SN2 is equal to or more than the threshold value $N_{th2}$, for a predetermined time until the liquid level of the ink in the liquid chamber 171 of the tank 160 reaches the predetermined position P, the ink is discharged from the head 21 by the amount of ink corresponding to the number of sheets N capable of recording an image.

The controller 130 displays a screen for informing that the ink is flowing into the tank 160 from the cartridge 200 on the display 17 (S85). The controller 130 determines whether or not the waiting time Tw elapses from the time stored in the EEPROM 134 (S86). When it is determined that the waiting time Tw does not elapse from the time stored in the EEPROM 134 (S86: No), the controller 130 continuously displays the above-mentioned screen on the display 17. That is, until the waiting time Tw elapses from the time stored in the EEPROM 134, image recording executed in the next step S18 is stopped. The operation executed by the display 17 in step S86 is an example of the second operation.

When it is determined that the waiting time Tw elapses from the time stored in the EEPROM 134 (S86: Yes), the controller 130 determines whether or not the signal output by the liquid level sensor 155 is the low-level signal (S87). When it is determined that the signal output by the liquid level sensor 155 is the low-level signal (S87: Yes), the controller 130 executes the processes from steps S75 to S76 described above and completes the Empty fully canceling process. Since the signal output by the liquid level sensor 155 is the low-level signal, it is confirmed that until the waiting time Tw elapses from the time stored in the EEPROM 134, the ink moves from the cartridge 200 to the tank 160 and the liquid level of the ink in the liquid chamber 171 reaches the predetermined position P. Thus, the Empty temporary canceling state is ended.

On the other hand, when it is determined that the signal output by the liquid level sensor 155 is not the low-level signal, that is, the high-level signal (S87: No), the controller 130 executes the processes from steps S79 to S83 described above and completes the Empty fully canceling process. Thus, the Empty temporary canceling state is ended and the ink empty state immediately before Empty temporary canceling is set.

When it is determined that the in-tank non-residual amount flag is "ON" in step S15 in the image recording process (S15: Yes), the controller 130 executes the process illustrated in FIG. 11. As described above, if the ink amount Vc stored in the memory of the IC substrate 247 is larger than the amount of ink substantially stored in the cartridge 200 or the movement of ink from the cartridge 200 to the tank 160 is inhibited, the liquid level of the ink in the liquid chamber 171 of the tank 160 is not raised to the predetermined position P. In this case, it is necessary that the cartridge 200 is exchanged with a new cartridge or the cartridge 200 in which ink is fully stored again.

However, in a state where the in-tank non-residual amount flag is "ON", the count value SN2 updated in step S70 has become already equal to or more than the threshold value $N_{th2}$. Thus, even when the cartridge 200 is exchanged again, it is not preferable to execute image recording in the Empty temporary canceling state since the above-described air-in may occur. Accordingly, when it is determined that the in-tank non-residual amount flag is "ON" (S15: Yes), the controller 130 does not execute the Empty temporary canceling process.

Figure 11:
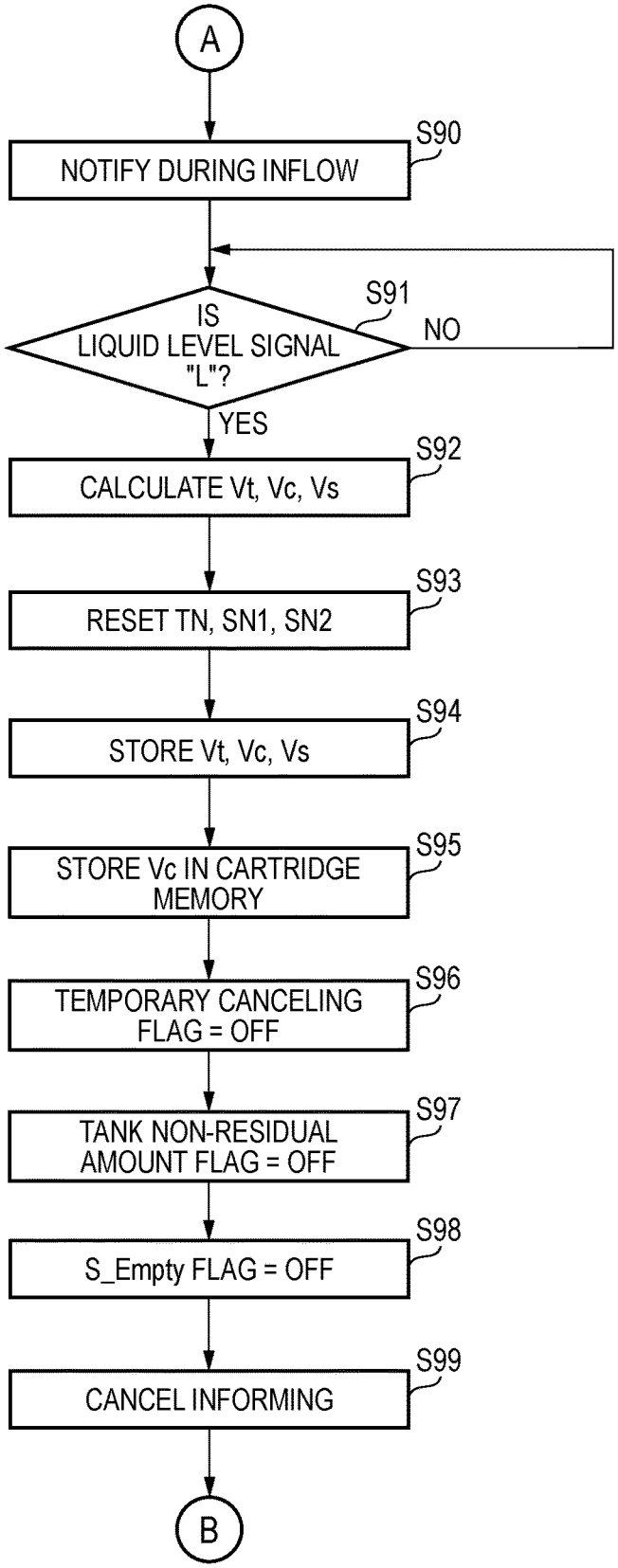
FIG. 11 is a flowchart illustrating a part of the image recording process.

As illustrated in FIG. 11, when it is determined that the in-tank non-residual amount flag is "ON" (S15: Yes), the controller 130 displays the screen for informing that the ink is flowing into the tank 160 from the cartridge 200 on the display 17 (S90).

Then, the controller 130 determines whether or not the signal output by the liquid level sensor 155 is the low-level signal (S91). When it is determined that the signal output by the liquid level sensor 155 is not the low-level signal, that is, the high-level signal (S91: No), the controller 130 repeatedly executes the process in step S91 until the signal output by the liquid level sensor 155 becomes the low-level signal.

When it is determined that the signal output by the liquid level sensor 155 is the low-level signal (S91: Yes), the controller 130 calculates the ink amount Vs (which is equal to the total amount Vt) before cartridge exchange based on the count value SN before cartridge exchange stored in the EEPROM 134 and the ink amount Vsc stored in the ROM 132 and stores the calculated value in the EEPROM 134. Based on the calculated ink amount Vs and the ink amount Vc read from the memory of the IC substrate 247 of the cartridge 200 after cartridge exchange, the total amount Vt after cartridge exchange is calculated (S92: Vt=Vs+Vc).

The controller 130 calculates the ink amount Vc and the ink amount Vs when the movement of ink from the liquid chamber 210 to the liquid chamber 171 is completed based on the calculated total amount Vt and the function F read from the EEPROM 134 (S92).

The controller 130 resets the count values TN, SN1, and SN2 stored in the EEPROM 134 (S93). Thus, the count values TN, SN1, and SN2 respectively become the initial value (zero).

The controller 130 displays the obtained current total amount Vt and one of the ink amount Vc and the ink amount Vs on the display 17 (S94). The controller 130 stores the calculated ink amount Vc in the memory of the substrate 247 through the contact 152 (S95).

Then, the controller 130 puts "OFF" into the temporary canceling flag, the in-tank non-residual amount flag, the S_Empty flag, and the C_Empty flag respectively (S96, S97, and S98). The controller 130 allows the ink to be discharged through the head 21 when all of the four S_Empty flags are set to "OFF". The controller 130 erases the S_Empty notification screen and the C_Empty notification screen from the display 17 (S99) and returns to the process in step S17. Accordingly, when the in-tank non-residual amount flag is "ON", that is, the ink is discharged more than the discharged amount through the head 21, in a situation where the above-described air-in occurs, it is confirmed that the liquid level of the ink in the liquid chamber 171 of the tank 160 reaches the predetermined position P based on the output of the liquid level sensor 155 without executing the temporary canceling of the ink empty state, and the ink empty state is canceled. Thus, the above-described air-in is prevented.

(Waiting Time Tw Setting Process)

Next, with reference to FIG. 14, details of the waiting time Tw setting process executed by the controller 130 will be described. The controller 130 independently executes the waiting time Tw setting process with respect to each of the four cartridges 200. Since the waiting time Tw setting process is common for each cartridge 200, only the waiting time Tw setting process corresponding to one cartridge 200 will be described.

The controller 130 executes the waiting time Tw setting process when the cartridge 200 is initially installed in the installation case 150 of the multifunction peripheral 10. The controller 130 determines whether or not the cartridge 200 is initially installed in the installation case 150 under the conditions that, for example, the identification information from the IC substrate 247 of the installed cartridge 200 is determined to indicate that the cartridge is packaged with the multifunction peripheral 10, a flag for indicating that the initial ink introduction operation is executed is not stored in the EEPROM 134, and the like. Based on the determination, the time from when the ink flows into the liquid chamber 171 in a state in which the liquid chamber 171 of the tank 160 is empty to when the liquid level of the ink reaches the predetermined position P is measured.

Figure 14:
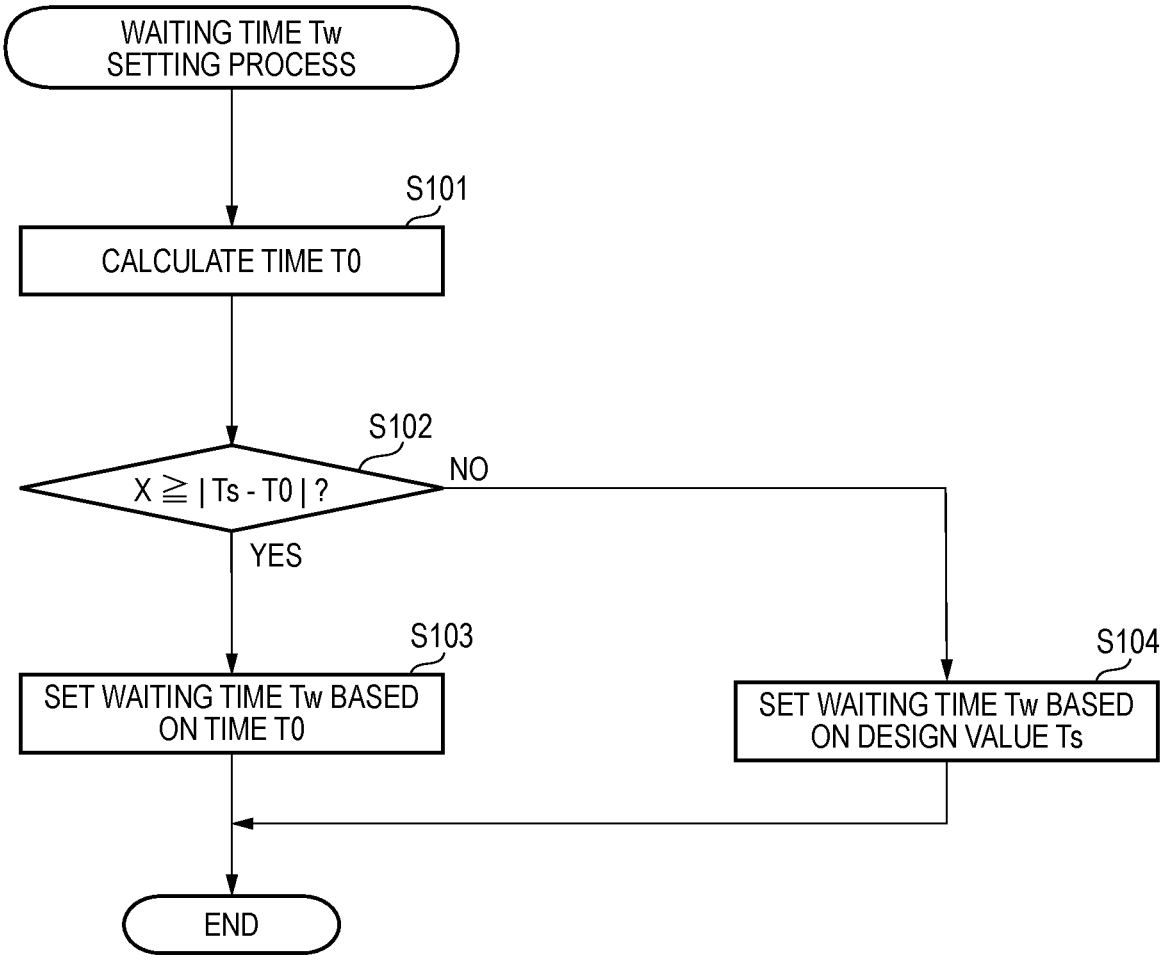
FIG. 14 is a flowchart illustrating a waiting time setting process.

As illustrated in FIG. 14, the controller 130 stores the time when the cartridge 200 is initially installed in the installation case 150, that is, the time when the high-level signal is obtained from the installation sensor 154 and then the low-level signal is further obtained from the installation sensor 154 in the EEPROM 134. Then, the controller 130 calculates a time T0 from the time stored in the EEPROM 134 to the change of the signal from the liquid level sensor 155 in response to the change the signal received from the liquid level sensor 155 from the high-level signal to the low-level signal (S101). The time T0 is an example of the second elapsed time.

When a new cartridge 200 is installed in the installation case 150, the ink flows into the liquid chamber 171 from the liquid chamber 210, the liquid level of the ink in the liquid chamber 171 then reaches the predetermined position Pas-time elapses, and thus the liquid level sensor 155 outputs the low-level signal.

Subsequently, the controller 130 calculates a difference between the calculated time T0 and the design value Ts stored in the EEPROM 134 in advance (|Ts−T0|) and determines whether or not the calculated difference is within the threshold value range X (S102: X≥|Ts−T0|). When the calculated difference is within the threshold value range X (S102: Yes), the controller 130 stores the time obtained by adding a predetermined additional time to the time T0 as the waiting time Tw in the EEPROM 134 (S103). When the calculated difference is out of the threshold value range X (S102: No), the controller 130 stores a time obtained by adding a predetermined additional time to the predetermined design value Ts as the waiting time Tw in the EEPROM 134 (S104).

According to the exemplary embodiment, in the ink empty state where the ink is prohibited from being discharged through the head 21, before the liquid level sensor 155 outputs the low-level signal after the cartridge 200 is exchanged, the ink empty state can be canceled. When a time elapsed from the exchange of the cartridge 200 reaches the waiting time Tw after the ink empty state is canceled, the ink empty state where the ink is prohibited from being discharged through the head 21 is set and thus, if the cartridge 200 in which the amount of ink required for making the liquid level of the ink in the liquid chamber 171 of the tank 160 equal to or higher than the predetermined position P is not stored in the liquid chamber 210 is installed in the installation case 150, the air can be prevented from entering the head 21 from the liquid chamber 171 of the tank 160.

When the time elapsed from the exchange of the cartridge 200 (an example of a first elapses time) reaches the waiting time Tw and the ink empty state is set, the count value SN2 updated by adding the count value SN2 to the count value SN1 until S_Empty is canceled is used.

In the ink empty state, before the liquid level sensor 155 outputs the low-level signal after the cartridge 200 is exchanged with a new cartridge 200, it is possible to release the prohibition of the discharge of ink through the head.

In addition it is possible to notify the user of prohibiting the ink from being discharged through the head 21 through the S_Empty notification screen on the display 17.

If the cartridge 200 in which the amount of ink required for making the liquid level of the ink in the liquid chamber 171 of the tank 160 equal to or higher than the predetermined position P is stored in the liquid chamber 210 is installed in the installation case 150 without exchanging the cartridge 200 with a new cartridge 200, the ink empty state is canceled before the liquid level sensor 155 outputs the low-level signal.

Further, when the cartridge 200 in which the amount of ink required for making the liquid level of the ink in the liquid chamber 171 of the tank 160 equal to or higher than the predetermined position P is not stored in the liquid chamber 210 is installed in the installation case 150, it is possible to notify the user of necessity of exchanging the cartridge 200 with a new cartridge 200 by displaying the C_Empty notification screen on the display 17.

When the sum of the count value SN2 and the count value SN1 reaches the threshold value $N_{th2}$ after the ink empty state is canceled, the ink empty state is set and thus the controller 130 can limit the amount of ink discharged from the head 21 before receiving the low-level signal from the liquid level sensor 155. Thus, the air is prevented from entering the head 21 from the liquid chamber 171. Then, when the low-level signal is received from the liquid level sensor 155, the ink empty state is canceled. Therefore, the prohibited discharge of ink from the head 21 is executed.

Since the waiting time Tw is set based on the time elapsed from when the cartridge 200 is initially installed in the installation case 150 to when the liquid level sensor 155 outputs the low-level signal, the waiting time Tw can be set according to a difference between individual devices.

In addition, when the temporary canceling state, that is, the temporary canceling flag is "ON", the controller 130 puts "OFF" into the temporary canceling flag in response to determining that the controller receives the low-level signal from the liquid level sensor 155. Thus, when the liquid level of the liquid chamber 171 is substantially equal to or higher than the predetermined position P after the cartridge is exchanged, the temporary canceling state is canceled. Regarding the in-tank non-residual amount flag, similarly, when the liquid level of the liquid chamber 171 is substantially equal to or higher than the predetermined position P after the cartridge is exchanged, the controller puts "OFF" into the in-tank non-residual amount flag. As a result, the above-described air-in is prevented.

(Modification to Exemplary Embodiments)

In the Empty temporary canceling process in the above-described exemplary embodiment, whether or not the initial ink amount Vc0 is stored in the cartridge 200 installed in the installation case 150, that is, whether or not the cartridge 200 is a new cartridge 200 is determined (S52), or whether the total amount Vt which is the sum of the ink amount Vc of the liquid chamber 210 and the ink amount Vs of the liquid chamber 171 is equal to or more than threshold value Vmin when the cartridge 200 which is not a new cartridge is installed in the installation case 150 is determined (S53). However, steps S52 to S55 may not be necessarily executed. That is, the controller 130 may temporarily cancel the ink empty state in response to the installing of the cartridge 200 in the installation case 150. In addition, step S54 may be executed without executing steps S52 and S53 and may be executed together with selectively executed step S52 or S53.

In the above-described exemplary embodiment, the discharge of ink through the head 21 is described as image recording on a sheet. However, the discharge of ink through the head 21 may be so-called purge in which the ink is forcibly discharged from the nozzle 29 of the head 21.

In the above-described exemplary embodiment, the controller 130 prohibits the ink from being discharged through the head 21 when the S_Empty flag is "ON". However, the discharge of ink through the head 21 is not necessarily prohibited and the controller 130 may only display the S_Empty notification screen on the display 17 when the S_Empty flag is "ON". Similarly, the controller 130 prohibits the ink from being discharged through the head 21 when the in-tank non-residual amount flag is "ON". However, the discharge of ink through the head 21 is not necessarily prohibited and the controller 130 may only display the S_Empty notification screen on the display 17 when the S_Empty flag is "ON". In contrast, the controller 130 may only prohibit the ink from being discharged through the head 21 without displaying the S_Empty notification screen on the display 17 when the S_Empty flag is "ON". Thus, it is possible to at least prevent air-in. Similarly, the controller 130 may only prohibit the ink from being discharged through the head 21 without displaying the notification screen indicating that the ink is flowing into the tank on the display 17 when the in-tank non-residual amount flag is "ON".

In the above-described exemplary embodiment, the controller 130 stores the total amount Vt after the cartridge 200 is exchanged in the EEPROM 134 and obtains the current total amount Vt by subtracting the ink amount corresponding to the count value TN from the total amount Vt. However, instead of this method, the controller may update the total amount Vt by updating the total amount Vt every time the ink is discharged through the head 21, storing the updated amount in the EEPROM 134, calculating the ink amount corresponding to the amount of the ink discharge executed when the next discharge of ink through the head 21 is executed based on the count value TN and subtracting the obtained amount from the total amount Vt stored in the EEPROM 134.

In the above-described exemplary embodiment, the controller 130 is configured to detect whether or not the detection target portion 194 of the actuator 190 is located at the detection position based on the signal output by the liquid level sensor 15. However, the configuration of the liquid level sensor 155 is not particularly limited as long as the liquid level of the ink in the liquid chamber 171 can be detected. For example, the controller 130 may be a sensor for optically detecting the liquid level of the ink in the liquid chamber 171 using a prism having a different reflectivity depending on whether or not the ink makes contact with the rear wall 164 of the liquid chamber 171. In addition, the liquid level sensor 155 may be an electrode rod inserted into the liquid chamber 171. Further, the liquid level sensor 155 may be configured to detect whether or not the liquid level of the liquid chamber 210 of the cartridge 200 is equal to or higher than a predetermined position.

In the above-described exemplary embodiment, the C_Empty flag is set to "ON" in response to the change of the output of the liquid level sensor 155 from the low-level signal to the high-level signal and the C_Empty notification screen is displayed on the display 17. However, instead of this configuration, when the count value SN1 reaches a predetermined threshold value after the output of the liquid level sensor 155 is changed from the low-level signal to the high-level signal, the C_Empty notification screen may be displayed on the display 17 by setting the C_Empty flag to "ON".

In the above-described image recording process, the image recording operation, that is, the operations of steps S11 to S17 excluding the operation in step S18 and the subsequent operations may be executed when the cover 87 is closed or when the power of the printer is turned ON.

In the above-described exemplary embodiment, the controller 130 executes the process illustrated in step S15 in response to obtaining the low-level signal from the installation sensor 154, then obtaining the high-level signal from the installation sensor 154, and further obtaining the low-level signal from the installation sensor 154 (S14: Yes). The controller 130 executes the process illustrated in step S15 when the cartridge 200 is installed in the installation case 150 in which the cartridge 200 is not present in the installation case 150. That is, the controller 130 may execute the process illustrated in step S15 when it is determined that the cartridge 200 is installed in the installation case 150. The fact that the controller obtains the low-level signal from the installation sensor 154, then obtains the high-level signal from the installation sensor 154, and further obtains the low-level signal from the installation sensor 154 is an example in which the controller 130 determines that the cartridge is installed in the installation case 150. Other examples in which the controller 130 determines that the cartridge 200 is installed in the installation case 150 will be described below.

For example, the controller 130 receives the low-level signal after receiving the high-level signal from the cover sensor 88. Then, the controller 130 reads the identification information from the memory of the IC substrate 247 and compares the read identification information with the identification information of the cartridge 200 before exchange stored in the EEPROM 134. When it is determined that the identification information read from the memory of the IC substrate 247 and the identification information stored in the EEPROM 134 are different from each other, the controller 130 may execute the process illustrated in step S15. That is, "the controller 130 reads identification information from the memory of the IC substrate 247 and compares the read identification information with the identification information of the cartridge 200 before exchange stored in the EEPROM 134. As a result, it is determined that the identification information read from the memory of the IC substrate 247 and the identification information stored in the EEPROM 134 are different from each other" is an example in which the controller 130 determines that the cartridge 200 is installed in the installation case 150. In this case, the controller 130 reads the identification information from the memory of the IC substrate 247, compares the read identification information with the identification information of the cartridge 200 before exchange stored in the EEPROM 134, and stores the time when it is determined that the identification information read from the memory of the IC substrate 247 and the identification information stored in the EEPROM 134 are different from each other in the EEPROM as the time to be stored the identification information in step S15. Alternately, the time when the controller receives the low-level signal after receiving the high-level signal from the cover sensor 88 may be stored in the EEPROM in step S15.

For example, the controller 130 receives the low-level signal after receiving the high-level signal from the cover sensor 88. Then, the controller 130 causes the user to display a confirmation screen indicating whether or not a new cartridge 200 is installed in the installation case 150 through the display 17. The controller 130 receives an input corresponding to the confirmation screen through the operation panel 22 while the confirmation screen is being displayed on the display 17. The controller 130 executes the process illustrated in step S15 when the received input corresponds to the installing of a new cartridge 200 in the installation case 150. That is, "the controller 130 receives the low-level signal after receiving the high-level signal from the cover sensor 88. Then, the controller 130 causes the user to display a confirmation screen indicating whether or not a new cartridge 200 is installed in the installation case 150 through the display 17. The controller 130 receives an input corresponding to the confirmation screen through the operation panel 22 while the confirmation screen is being displayed on the display 17. The received input corresponds to the installing of a new cartridge 200 in the installation case 150" is an example in which the controller 130 determines that the cartridge 200 is installed in the installation case 150. In this case, the controller 130 stores the time when the input corresponding to the confirmation screen is received through the operational panel 22 in the EEPROM as the time to be stored in step S15.

In addition, the IC substrate 247 is electrically connectable with the contact with the contact 152. However, an information medium and an interface for reading and writing data in a contactless manner using radio waves such as near field communication (NFC) or radio frequency identification (RFID) may be adopted.

Furthermore, in the exemplary embodiment described above, the ink is an example of liquid. However, the liquid, for example, may be pretreatment liquid discharged to a paper and the like prior to ink at the time of image recording, or may be water for cleaning the head 21.

As discussed above, the disclosure may provide at least the following illustrative, non-limiting embodiments.

(1) A liquid discharge device comprising: an installation case configured to receive a cartridge, the cartridge comprising: a first liquid chamber storing a liquid; a first flow path, one end of the first flow path communicated with the first liquid chamber, the other end of the first flow path communicated with the outside of the cartridge; and a second flow path, one end of the second flow path communicated with the first liquid chamber, the other end of the second flow path communicated with the outside of the cartridge; a tank comprising: a second liquid chamber; a third flow path, one end of the third flow path communicated with the outside, the other end of the third flow path communicated with the second liquid chamber, at least one of the first flow path and the third flow path configured to communicate with the first liquid chamber of the cartridge installed in the installation case and the second liquid chamber; a fourth flow path, one end of the fourth flow path being below the other end of the third flow path and communicated with the second liquid chamber; and a fifth flow path, one end of the fifth flow path communicated with the second liquid chamber, the other end of the fifth flow path communicated with the outside; a head communicated with the other end of the fourth flow path; a liquid level sensor; and a controller configured to: receive, from the liquid level sensor, a first signal in a case a position of a liquid level in the second liquid chamber is equal to or higher than a predetermined position; receive, from the liquid level sensor, a second signal in a case the position of the liquid level in the second liquid chamber is lower than the predetermined position; receive a discharge instruction to discharge a liquid through the head and update a first count value with a value equivalent to an amount of the liquid instructed to be discharged by the discharge instruction after receiving the second signal; in a case the first count value reaches a first threshold, prohibit a liquid discharge through the head; determine that the cartridge is installed in the installation case; based on determining that the cartridge is installed in the installation case, cancel the prohibition of the liquid discharge through the head; and based on determining that a first elapsed time from a time when it is determined that the cartridge is installed in the installation case reaches a predetermined time and the second signal is received from the liquid level sensor without receiving the first signal, prohibit the liquid discharge through the head.

According to the above configuration, in the state where the liquid discharge through the head is prohibited, before the liquid level sensor outputs the signal indicating that the liquid level of the second liquid chamber is equal to or higher than the predetermined position after the cartridge is exchanged, the prohibition of the liquid discharge through the head can be canceled. In addition, when the first elapsed time reaches the predetermined time after the prohibition of the liquid discharge through the head is canceled, since the liquid discharge through the head is prohibited. Therefore, even if the cartridge, in which the liquid necessary for the liquid level of the second liquid chamber to reach the predetermined position or higher is not stored in the first liquid chamber, is installed in the installation case, air can be prevented from entering the head from the second liquid chamber.

(2) The liquid discharge device of (1), further comprising: a memory, wherein the controller is configured to: based on canceling the prohibition of the liquid discharge through the head, store the first count value in the memory; receive a discharge instruction to discharge the liquid through the head after canceling the prohibition of the liquid discharge through the head and update a second count value with a value equivalent to an amount of the liquid instructed to be discharged by the discharge instruction; based on determining that the first elapsed time reaches the predetermined time and the second signal is received from the liquid level sensor, read the first count value stored in the memory and calculate a third count value obtained by adding the second value to the first count value; and update the third count value with the value equivalent to the amount of the liquid instructed to be discharged by the discharge instruction.

According to the above configuration, when the liquid discharge through the head is prohibited after lapse of the predetermined time, it is possible to use the third count value obtained by adding the second value to the first value until the prohibition of the liquid discharge through the head is canceled.

(3) A liquid discharge device comprising: an installation case configured to receive a cartridge, the cartridge comprising: a first liquid chamber storing a liquid; a first flow path, one end of the first flow path communicated with the first liquid chamber, the other end of the first flow path communicated with the outside of the cartridge; and a second flow path, one end of the second flow path communicated with the first liquid chamber, the other end of the second flow path communicated with the outside of the cartridge; a tank comprising: a second liquid chamber; a third flow path, one end of the third flow path communicated with the outside, the other end of the third flow path communicated with the second liquid chamber, at least one of the first flow path and the third flow path configured to communicate with the first liquid chamber of the cartridge installed in the installation case and the second liquid chamber; a fourth flow path, one end of the fourth flow path being below the other end of the third flow path and communicated with the second liquid chamber; and a fifth flow path, one end of the fifth flow path communicated with the second liquid chamber, the other end of the fifth flow path communicated with the outside; a head communicated with the other end of the fourth flow path; a liquid level sensor; an interface; and a controller configured to: receive, from the liquid level sensor, a first signal in a case a position of a liquid level in the second liquid chamber is equal to or higher than a predetermined position; receive, from the liquid level sensor, a second signal in a case the position is lower than the predetermined position; receive a discharge instruction to discharge a liquid through the head and update a first count value with a value equivalent to an amount of the liquid instructed to be discharged by the discharge instruction after receiving the second signal; in a case the first count value reaches a first threshold, prohibit a liquid discharge through the head; determine that the cartridge is installed in the installation case; based on determining that the cartridge is installed in the installation case, read initial information from a cartridge memory of the cartridge through the interface, the initial information indicating that an initial filling amount of liquid is stored in the first liquid chamber; and based on reading the initial information from the cartridge memory, cancel the prohibition of the liquid discharge through the head.

According to the above configuration, in the state where the liquid discharge through the head is prohibited, before the liquid level sensor outputs the signal indicating that the liquid level of the second liquid chamber is equal to or higher than the predetermined position after the cartridge is exchanged, the prohibition of the liquid discharge through the head can be canceled. In addition, when the used cartridge is installed in the installation case, the prohibition of the liquid discharge through the head is not canceled.

(4) The liquid discharge device of (1) or (2), further comprising: an alarm, wherein the controller is configured to: in a case the first count value reaches the first threshold, control the alarm to perform a first notification; and based on determining that the cartridge is installed in the installation case, cancel the first notification of the alarm.

According to the above configuration, it is possible to notify the user, through the first notification of the alarm, that the prohibition of the liquid discharge through the head is prohibited.

(5) The liquid discharge device of (3), further comprising: an alarm, wherein the controller is configured to: in a case the first count value reaches the first threshold, control the alarm to perform a first notification; and based on reading the initial information from the cartridge memory, cancel the first notification of the alarm.

According to the above configuration, it is possible to notify the user, through the first notification of the alarm, that the prohibition of the liquid discharge through the head is prohibited.

(6) A liquid discharge device comprising: an installation case configured to receive a cartridge, the cartridge comprising: a first liquid chamber storing a liquid; a first flow path, one end of the first flow path communicated with the first liquid chamber, the other end of the first flow path communicated with the outside of the cartridge; and a second flow path, one end of the second flow path communicated with the first liquid chamber, the other end of the second flow path communicated with the outside of the cartridge; a tank comprising: a second liquid chamber; a third flow path, one end of the third flow path communicated with the outside, the other end of the third flow path communicated with the second liquid chamber, at least one of the first flow path and the third flow path configured to communicate with the first liquid chamber of the cartridge installed in the installation case and the second liquid chamber, a fourth flow path, one end of the fourth flow path being below the other end of the third flow path and communicated with the second liquid chamber; and a fifth flow path, one end of the fifth flow path communicated with the second liquid chamber, the other end of the fifth flow path communicated with the outside; a head communicated with the other end of the fourth flow path; a liquid level sensor; an interface; and a controller configured to: receive, from the liquid level sensor, a first signal in a case a position of a liquid level in the second liquid chamber is equal to or higher than a predetermined position; receive, from the liquid level sensor, a second signal in a case the position is lower than the predetermined position; receive a discharge instruction to discharge a liquid through the head and update a first count value with a value equivalent to an amount of the liquid instructed to be discharged by the discharge instruction after receiving the second signal; in a case the first count value reaches a first threshold, prohibit a liquid discharge through the head; determine that the cartridge is installed in the installation case; based on determining that the cartridge is installed in the installation case, read a first liquid amount from a cartridge memory of the cartridge through the interface, the first liquid amount being amount of the liquid stored in the first liquid chamber, based on the first liquid amount read from the cartridge memory and amount of liquid stored in the second liquid chamber, calculate a total amount of the liquid stored in the first liquid chamber and the second liquid chamber; and in a case the calculated total amount is equal to or larger than a liquid amount at which the position of the liquid level in the second liquid chamber is equal to or higher than the predetermined position, cancel the prohibition of the liquid discharge through the head.

According to the above configuration, even if the initial filling amount of liquid is not stored in the first liquid chamber, when the cartridge, in which the liquid necessary for the liquid level of the second liquid chamber to reach the predetermined position or higher is stored in the first liquid chamber, is installed in the installation case, the prohibition of the liquid discharge through the head is canceled before the liquid level sensor outputs the signal indicating that the liquid level of the second liquid chamber is equal to or higher than the predetermined position.

(7) The liquid discharge device of (6), further comprising: an alarm, wherein the controller is configured to in a case the calculated total amount is smaller than the liquid amount at which the position of the liquid level in the second liquid chamber is equal to or higher than the predetermined position, cancel the prohibition of the liquid discharge through the head, and control the alarm to perform a notification indicating prompting replacement of the cartridge.

According to the above configuration, when the cartridge, in which the liquid necessary for the liquid level of the second liquid chamber to reach the predetermined position or higher is not stored in the first liquid chamber, is installed in the installation case, it is possible to perform the liquid discharge through the head and to notify the user, through the alarm, that the exchange of the cartridge is required.

(8) The liquid discharge device according to any one of (1) to (3) and (6), wherein the controller is configured to: receive a discharge instruction to discharge the liquid through the head and update a second count value with a value equivalent to an amount of the liquid instructed to be discharged by the discharge instruction after canceling the prohibition of the liquid discharge through the head; based on receiving the second signal without receiving the first signal from the liquid level and based on the discharge instruction when the second count value reaches a second threshold, prohibit the liquid discharge through the head; and after prohibiting the liquid discharge through the head, based on receiving the first signal from the liquid level sensor, execute the liquid discharge through the head.

According to the above configuration, it is possible to limit the amount of liquid discharged from the head before the controller receives the first signal from the liquid level sensor after the prohibition of the liquid discharge through the head is canceled. Thus, the air is inhibited from entering the head from the second liquid chamber. Further, when the controller receives the first signal from the liquid level sensor, the liquid discharge through the head is executed.

(9) The liquid discharge device according to (8), further comprising: a memory, wherein the controller is configured to: based on receiving the second signal from the liquid level sensor and the second count value reaching the second threshold, prohibit the liquid discharge through the head; based on determining that the first elapsed time reaches the predetermined time, receiving the second signal from the liquid level sensor and the second count value reaching the second threshold, update a first value to a second value, the first value indicating that a residual amount of the second liquid chamber stored in the memory is equal to or more than a residual amount corresponding to the second threshold, the second value indicating that the residual amount of the second liquid chamber is less than the residual amount corresponding to the second threshold; based on determining, after prohibiting the liquid discharge through the head, that the cartridge is installed in the installation case, read the value stored in the memory; and based on receiving, in a case the value read from the memory is the second value, the first signal from the liquid level sensor, cancel the prohibition of the liquid discharge through the head and update the second value stored in the memory to the first value.

(10) The liquid discharge device according to (9), further comprising: an alarm, wherein the controller is configured to: control the alarm to perform a first notification based on prohibiting the liquid discharge through the head; based on canceling the prohibition of the liquid discharge through the head, cancel the first notification of the alarm; based on receiving the second signal from the liquid level sensor and the second count value reaching the second threshold after canceling the first notification, control the alarm to perform a second notification, the second notification being different from the first notification; based on determining that the first elapsed time reaches the predetermined time and the second signal is received without receiving the first signal, control the alarm to operate the first notification; based on determining, after controlling the alarm to perform the first notification, that the cartridge is installed in the installation case, read the value stored in the memory; in a case the value read from the memory is the second value, control the alarm to perform the second notification; and based on receiving, after controlling the alarm to perform the second notification, the first signal from the liquid level sensor, cancel the second notification of the alarm.

According to the above configuration, it is possible to notify the user, through the first notification of the alarm, that the prohibition of the liquid discharge through the head is prohibited.

(11) The liquid discharge device according to any one of (8) to (10), wherein the controller is configured to, based on a second elapsed time until a time when receiving the first signal from the liquid level sensor from a time when it is determined that the cartridge is initially installed in the installation case, set the predetermined time.

According to the above configuration, depending on the second elapsed time from when the liquid flows out from the first liquid chamber to the second liquid chamber of the cartridge initially installed in the installation case of the liquid discharge device until when the controller receives the first signal from the liquid level sensor, the predetermined time is set. Thus, the predetermined time can be set according to the individual difference for each device.

According to the disclosure, it is possible to release prohibition of liquid discharge through a head before a liquid level in a second liquid chamber reaches a predetermined position or more after a cartridge having a first liquid chamber is exchanged.

What is claimed is:

1. A liquid discharge device comprising:

an installation case configured to receive a cartridge, the cartridge comprising:

a first liquid chamber storing a liquid;

a first flow path, one end of the first flow path communicated with the first liquid chamber, the other end of the first flow path communicated with the outside of the cartridge; and a second flow path, one end of the second flow path communicated with the first liquid chamber, the other end of the second flow path communicated with the outside of the cartridge;

a tank comprising:

a second liquid chamber;

a third flow path, one end of the third flow path communicated with the outside, the other end of the third flow path communicated with the second liquid chamber, at least one of the first flow path and the third flow path configured to communicate with the first liquid chamber of the cartridge installed in the installation case and the second liquid chamber;

a fourth flow path, one end of the fourth flow path being below the other end of the third flow path and communicated with the second liquid chamber; and a fifth flow path, one end of the fifth flow path communicated with the second liquid chamber, the other end of the fifth flow path communicated with the outside;

a head communicated with the other end of the fourth flow path;

a liquid level sensor;

an interface; and a controller configured to:

receive, from the liquid level sensor, a first signal in a case a position of a liquid level in the second liquid chamber is equal to or higher than a predetermined position;

receive, from the liquid level sensor, a second signal in a case the position is lower than the predetermined position;

receive a discharge instruction to discharge a liquid through the head and update a first count value with a value equivalent to an amount of the liquid instructed to be discharged by the discharge instruction after receiving the second signal;

in a case the first count value reaches a first threshold, prohibit a liquid discharge through the head;

determine that the cartridge is installed in the installation case;

based on determining that the cartridge is installed in the installation case, read information from a cartridge memory through the interface, the information indicating an amount of liquid in the first liquid chamber; and based on the information read from the cartridge memory, determine whether the prohibition of liquid discharge through the head is cancelled.

2. The liquid discharge device according to claim 1, wherein the controller is configured to, based on read information indicating an initial filling amount of liquid, determine that the prohibition of the liquid discharge through the head is cancelled.

3. The liquid discharge device according to claim 2, wherein the controller is configured to, after determining that the prohibition is cancelled, cancel the prohibition.

4. The liquid discharge device according to claim 3, wherein the controller is configured to:

receive a discharge instruction to discharge the liquid through the head and update a second count value with a value equivalent to an amount of the liquid instructed to be discharged by the discharge instruction after canceling the prohibition of the liquid discharge through the head;

based on receiving the second signal without receiving the first signal from the liquid level and based on the discharge instruction when the second count value reaches a second threshold, prohibit the liquid discharge through the head; and based on receiving, after prohibiting the liquid discharge through the head, the first signal from the liquid level sensor, execute the liquid discharge through the head.

5. The liquid discharge device according to claim 4, further comprising:

a memory, wherein the controller is configured to:

based on receiving the second signal from the liquid level sensor and the second count value reaching the second threshold, prohibit the liquid discharge through the head;

based on determining that the first elapsed time reaches the predetermined time, the second signal is received from the liquid level sensor and the second count value reaches the second threshold, update a first value to a second value, the first value indicating that a residual amount of the second liquid chamber stored in the memory is equal to or more than a residual amount corresponding to the second threshold, the second value indicating that the residual amount of the second liquid chamber is less than the residual amount corresponding to the second threshold;

after prohibiting the liquid discharge through the head, based on determining that the cartridge is installed in the installation case, read the value stored in the memory; and in a case the value read from the memory is the second value, based on receiving the first signal from the liquid level sensor, cancel the prohibition of the liquid discharge through the head and update the second value stored in the memory to the first value.

6. The liquid discharge device according to claim 5, further comprising:

an alarm, wherein the controller is configured to:

control the alarm to perform a first notification based on prohibiting the liquid discharge through the head;

based on canceling the prohibition of the liquid discharge through the head, cancel the first notification of the alarm;

based on receiving the second signal from the liquid level sensor and the second count value reaching the second threshold after canceling the first notification, control the alarm to perform a second notification, the second notification being different from the first notification;

based on determining that the first elapsed time reaches the predetermined time and the second signal is received without receiving the first signal, control the alarm to operate the first notification;

based on determining, after controlling the alarm to perform the first notification, that the cartridge is installed in the installation case, read the value stored in the memory;

in a case the value read from the memory is the second value, control the alarm to perform the second notification; and based on receiving, after controlling the alarm to perform the second notification, the first signal from the liquid level sensor, cancel the second notification of the alarm.

7. The liquid discharge device according to claim 4, wherein the controller is configured to, based on a second elapsed time until a time when receiving the first signal from the liquid level sensor from a time when it is determined that the cartridge is initially installed in the installation case, set the predetermined time.

8. The liquid discharge device according to claim 1, wherein the controller is configured to, based on the information read from the cartridge memory, calculate a total amount of the liquid in the first liquid chamber and the second liquid chamber.

9. The liquid discharge device according to claim 8, wherein the controller is configured to, in a case the calculated total amount is equal to or larger than a liquid amount at which the position of the liquid level in the second liquid chamber is equal to or higher than the predetermined position, determine that the prohibition of the liquid discharge through the head is cancelled.

10. The liquid discharge device according to claim 9, further comprising:

an alarm, wherein the controller is configured to, in a case the calculated total amount is smaller than the liquid amount at which the position of the liquid level in the second liquid chamber is equal to or higher than the predetermined position, cancel the prohibition of the liquid discharge through the head, and control the alarm to perform a notification indicating prompting replacement of the cartridge.

11. The liquid discharge device according to claim 9, wherein the controller is configured to:

after canceling the prohibition of the liquid discharge through the head, receive a discharge instruction to discharge the liquid through the head and update a second count value with a value equivalent to an amount of the liquid instructed to be discharged by the discharge instruction;

based on receiving the second signal without receiving the first signal from the liquid level and based on the discharge instruction when the second count value reaches a second threshold, prohibit the liquid discharge through the head; and after prohibiting the liquid discharge through the head, based on receiving the first signal from the liquid level sensor, execute the liquid discharge through the head.

12. The liquid discharge device according to claim 11, further comprising:

a memory, wherein the controller is configured to:

based on receiving the second signal from the liquid level sensor and the second count value reaching the second threshold, prohibit the liquid discharge through the head;

based on determining that the first elapsed time reaches the predetermined time, the second signal is received from the liquid level sensor and the second count value reaches the second threshold, update a first value to a second value, the first value indicating that a residual amount of the second liquid chamber stored in the memory is equal to or more than a residual amount corresponding to the second threshold, the second value indicating that the residual amount of the second liquid chamber is less than the residual amount corresponding to the second threshold;

based on determining, after prohibiting the liquid discharge through the head, that the cartridge is installed in the installation case, read the value stored in the memory; and based on receiving, in a case the value read from the memory is the second value, the first signal from the liquid level sensor, cancel the prohibition of the liquid discharge through the head and update the second value stored in the memory to the first value.

13. The liquid discharge device according to claim 12, further comprising:

an alarm, wherein the controller is configured to:

control the alarm to perform a first notification based on prohibiting the liquid discharge through the head;

based on canceling the prohibition of the liquid discharge through the head, cancel the first notification of the alarm;

based on receiving the second signal from the liquid level sensor and the second count value reaching the second threshold after canceling the first notification, control the alarm to perform a second notification, the second notification being different from the first notification;

based on determining that the first elapsed time reaches the predetermined time and the second signal is received without receiving the first signal, control the alarm to operate the first notification;

based on determining, after controlling the alarm to perform the first notification, that the cartridge is installed in the installation case, read the value stored in the memory;

in a case the value read from the memory is the second value, control the alarm to perform the second notification; and based on receiving, after controlling the alarm to perform the second notification, the first signal from the liquid level sensor, cancel the second notification of the alarm.

14. The liquid discharge device according to claim 11, wherein the controller is configured to, based on a second elapsed time until a time when receiving the first signal from the liquid level sensor from a time when it is determined that the cartridge is initially installed in the installation case, set the predetermined time.

15. A method executed by a controller of a liquid discharge device including a tank to be communicated with a cartridge and including a head communicated with the tank, comprising:

receiving, from a liquid level sensor of the liquid discharged device, a first signal in a case a position of a liquid level in the tank is equal to or higher than a predetermined position;

receiving, from the liquid level sensor, a second signal in a case the position is lower than the predetermined position;

receiving a discharge instruction to discharge a liquid through the head and update a first count value with a value equivalent to an amount of the liquid instructed to be discharged by the discharge instruction after receiving the second signal;

in a case the first count value reaches a first threshold, prohibiting a liquid discharge through the head;

determining that the cartridge is installed in an installation case of the liquid discharge device;

based on determining that the cartridge is installed in the installation case, reading information from a cartridge memory through the interface, the information indicating an amount of liquid in the installed cartridge; and based on the information read from the cartridge memory, determining whether the prohibition of liquid discharge through the head is cancelled.

* * * * *